US011171406B2

(12) United States Patent
Yun et al.

(10) Patent No.: US 11,171,406 B2
(45) Date of Patent: Nov. 9, 2021

(54) ANTENNA STRUCTURE INCLUDING CONDUCTIVE PATCH FED USING MULTIPLE ELECTRICAL PATHS AND ELECTRONIC DEVICE INCLUDING THE ANTENNA STRUCTURE

(71) Applicant: Samsung Electronics Co., Ltd., Suwon-si (KR)

(72) Inventors: Sumin Yun, Suwon-si (KR); Dongyeon Kim, Suwon-si (KR); Seongjin Park, Suwon-si (KR); Sehyun Park, Suwon-si (KR); Myunghun Jeong, Suwon-si (KR); Jehun Jong, Suwon-si (KR); Jaehoon Jo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 25 days.

(21) Appl. No.: 16/727,484

(22) Filed: Dec. 26, 2019

(65) Prior Publication Data

US 2020/0212539 A1 Jul. 2, 2020

(30) Foreign Application Priority Data

Dec. 26, 2018 (KR) ..... 10-2018-0169434

(51) Int. Cl.
*H01Q 1/22* (2006.01)
*H01Q 1/38* (2006.01)
(Continued)

(52) U.S. Cl.
CPC ..... *H01Q 1/2283* (2013.01); *H01Q 1/38* (2013.01); *H01Q 9/0414* (2013.01); *H01Q 9/0435* (2013.01); *H01Q 21/065* (2013.01)

(58) Field of Classification Search
CPC ..... H01Q 1/2283; H01Q 1/38; H01Q 21/065; H01Q 9/0414; H01Q 9/0435; H01Q 21/08; H01Q 9/045; H01Q 1/243
See application file for complete search history.

(56) References Cited

U.S. PATENT DOCUMENTS 6,320,542 B1 11/2001 Yamamoto et al.
9,806,422 B2 10/2017 Garcia et al.
(Continued)

FOREIGN PATENT DOCUMENTS

JP 2004-007038 A 1/2004
KR 10-2019-0098529 A 8/2019

OTHER PUBLICATIONS

Ito Osamu, JP2004007038 English translation, Jan. 8, 2004, pp. 1-8 (Year: 2004).*

(Continued)

*Primary Examiner* — Daniel D Chang
(74) *Attorney, Agent, or Firm* — Jefferson IP Law, LLP

(57) ABSTRACT

An electronic device is provided that includes, an antenna structure including a printed circuit board including first and second surfaces, at least one conductive patch interposed between the first second surfaces or is disposed on the first surface, the conductive patch including first to fourth areas placed in a clockwise direction with respect to a first imaginary axis extended in a first direction on the conductive patch and a second imaginary axis intersecting the first imaginary axis and perpendicular to the first imaginary axis, and at least one wireless communication circuit that transmits and/or receives a first signal having a frequency between 3 and 100 GHz. The wireless communication circuit includes a first port electrically connected to a first position of the first area, and a second port electrically
(Continued)

connected to a second position placed on an opposite side to the first position with respect to the first imaginary axis.

21 Claims, 20 Drawing Sheets

(51) Int. Cl.
*H01Q 21/06* (2006.01)
*H01Q 9/04* (2006.01)

(56) References Cited

U.S. PATENT DOCUMENTS

| | | | | |
|---|---|---|---|---|
| 9,819,096 | B2 | 11/2017 | Veihl et al. | |
| 10,079,436 | B2 | 9/2018 | Okunaga et al. | |
| 10,170,838 | B2 | 1/2019 | Garcia et al. | |
| 2008/0309428 | A1* | 12/2008 | Son | H01P 5/18 333/117 |
| 2013/0099006 | A1 | 4/2013 | Hong et al. | |
| 2013/0171946 | A1 | 7/2013 | Veihl et al. | |
| 2017/0317418 | A1 | 11/2017 | Garcia et al. | |
| 2018/0358686 | A1* | 12/2018 | Park | H01Q 9/42 |
| 2019/0027804 | A1* | 1/2019 | Kim | H01Q 21/0025 |
| 2020/0321686 | A1* | 10/2020 | Kim | H01Q 5/371 |

OTHER PUBLICATIONS

International Search Report dated Apr. 13, 2020, issued in International Application No. PCT/KR2019/018282.

* cited by examiner

ANTENNA STRUCTURE INCLUDING CONDUCTIVE PATCH FED USING MULTIPLE ELECTRICAL PATHS AND ELECTRONIC DEVICE INCLUDING THE ANTENNA STRUCTURE

CROSS-REFERENCE TO RELATED APPLICATION(S)

This application is based on and claims priority under 35 U.S.C. § 119(a) of a Korean patent application number 10-2018-0169434, filed on Dec. 26, 2018, in the Korean Intellectual Property Office, the disclosure of which is incorporated by reference herein in its entirety.

BACKGROUND

1. Field

The disclosure relates to a technology for implementing an antenna structure including a conductive patch multiple-fed by using a plurality of electrical paths and an electronic device in which the antenna structure is disposed.

2. Description of Related Art

As mobile communication technologies develop, an electronic device that is equipped with an antenna is widely supplied. The electronic device may at least one of transmit or receive a radio frequency (RF) signal including a voice signal or data (e.g., a message, a photo, a video, a music file, or a game) by using the antenna.

Meanwhile, nowadays, the electronic device may perform communication by using a high frequency (e.g., $5^{th}$ generation (5G) communication or a millimeter wave). In the case of performing the high-frequency communication, an antenna array may be used to overcome high transmission loss. A feeding port may be connected to each of antenna elements constituting the antenna array. In the case where the number of antenna elements increases, the gain of the antenna array may increase. Also, in the case where the total number of feeding ports connected to the antenna array increases, an output power of the antenna array may increase.

The above information is presented as background information only to assist with an understanding of the disclosure. No determination has been made, and no assertion is made, as to whether any of the above might be applicable as prior art with regard to the disclosure.

SUMMARY

Nowadays, as the size of the electronic device decreases, an antenna structure including an antenna array may be miniaturized so as to be mounted within the electronic device. In the case where the number of antenna elements increases, the size of the antenna structure may increase, and thus, it may be difficult to mount the antenna structure on the electronic device. In the case of decreasing the number of antenna elements included in the antenna structure for the purpose of mounting the antenna structure on the electronic device, the gain of the antenna structure may decrease.

Aspects of the disclosure are to address at least the above-mentioned at least one of problems or disadvantages and to provide at least the advantages described below. Accordingly, an aspect of the disclosure is to provide an electronic device for maintaining a performance of an antenna structure by connecting a plurality of feeding ports to an antenna element included in the antenna structure.

Additional aspects will be set forth in part in the description which follows and, in part, will be apparent from the description, or may be learned by practice of the presented embodiments.

In accordance with an aspect of the disclosure, an electronic device is provided. The electronic device includes a housing that includes a first plate, a second plate facing away from the first plate, and a side member surrounding a space between the first plate and the second plate and connected with the second plate or integrally formed with the second plate, a display that is viewable through at least a portion of the first plate, an antenna structure that is disposed within the housing, the antenna structure including a printed circuit board including a first surface and a second surface facing away from the first surface, and at least one conductive patch that is interposed between the first surface and the second surface or is disposed on the first surface, the conductive patch including first to fourth areas placed in a clockwise direction with respect to a first imaginary axis extended in a first direction on the conductive patch and a second imaginary axis intersecting the first imaginary axis and perpendicular to the first imaginary axis on the conductive patch, and at least one wireless communication circuit that at least one of transmits or receives a first signal having a frequency between 3 GHz and 100 GHz. The wireless communication circuit may include a first port electrically connected to a first position of the first area, and a second port electrically connected to a second position placed on an opposite side to the first position with respect to the first imaginary axis.

In accordance with another aspect of the disclosure, an electronic device is provided. The electronic device includes a housing that includes a first plate, a second plate facing away from the first plate, and a side member surrounding a space between the first plate and the second plate and connected with the second plate or integrally formed with the second plate, a display that is viewable through at least a portion of the first plate, at least one wireless communication circuit that includes a first port and a second port and at least one of transmits or receives a first signal having a frequency between 3 GHz and 100 GHz, and an antenna structure that is disposed within the housing. The antenna structure may include a printed circuit board including a first surface and a second surface facing away from the first surface, at least one conductive pattern interposed between the first surface and the second surface, or disposed on the first surface, and a combiner electrically connected with the first port, the second port, and the conductive pattern.

In accordance with another aspect of the disclosure, an electronic device is provided. The electronic device includes a housing that includes a first plate, a second plate facing away from the first plate, and a side member surrounding a space between the first plate and the second plate and connected with the second plate or integrally formed with the second plate, an antenna structure that is disposed within the housing, a wireless communication circuit that is connected to the antenna structure and at least one of transmits or receives a first signal of a specified frequency, and one or more processors operatively connected to the wireless communication circuit. The antenna structure may include a first antenna element, the wireless communication circuit may include a first feeding part connected to a first position, and a second feeding part connected to a second position, and the wireless communication circuit may feed the first feeding part and the second feeding part. The first feeding part may be connected with the first antenna element through a first feeding line at the first position, the second feeding part may be connected with the first antenna element through a second feeding line at the second position, and the first position and the second position may be symmetrical with respect to a first imaginary axis extended in a first direction on the first antenna element.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modification of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
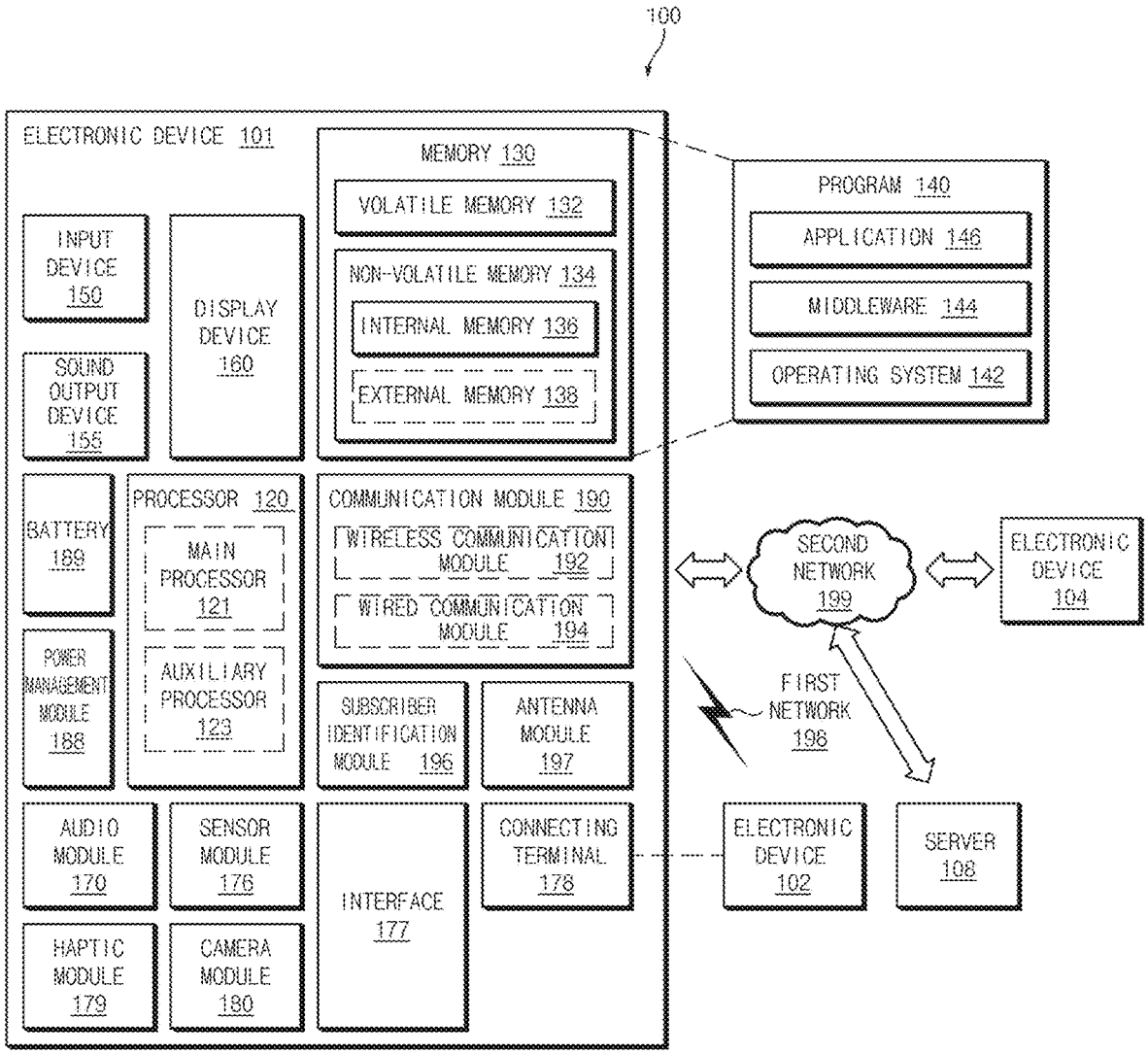
FIG. 1 is a block diagram illustrating an electronic device in a network environment according to an embodiment of the disclosure.

FIG. 1 is a block diagram illustrating an electronic device 101 in a network environment 100 according to an embodiment of the disclosure.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by another component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
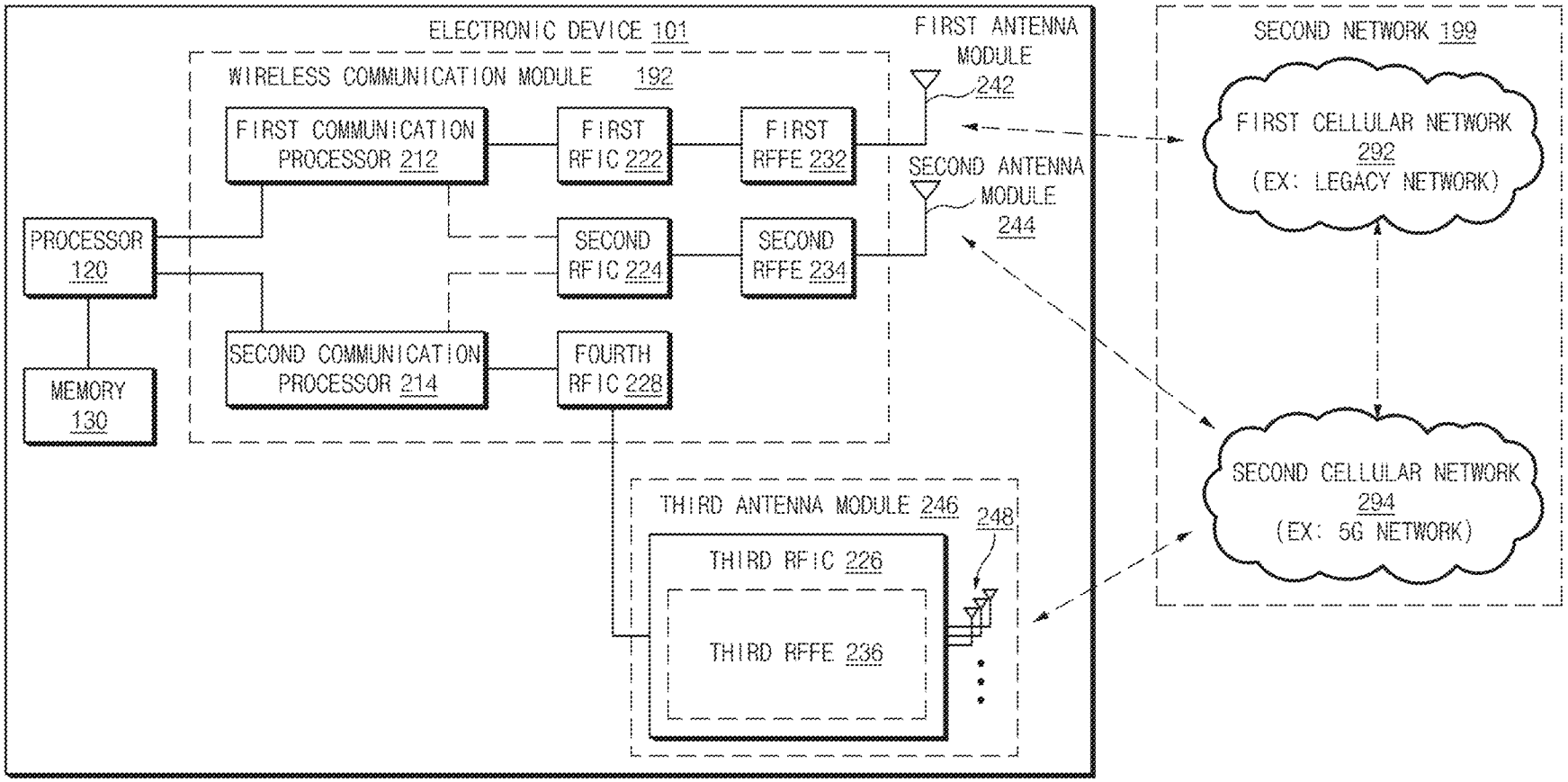
FIG. 2 is a block diagram of an electronic device for supporting legacy network communication and 5G network communication according to an embodiment of the disclosure.

FIG. 2 is a block diagram of the electronic device 101 for supporting legacy network communication and 5G network communication, according to an embodiment of the disclosure.

Referring to FIG. 2, the electronic device 101 may include a first communication processor 212, a second communication processor 214, a first radio frequency integrated circuit (RFIC) 222, a second RFIC 224, a third RFIC 226, a fourth RFIC 228, a first radio frequency front end (RFFE) 232, a second RFFE 234, a first antenna module 242, a second antenna module 244, and an antenna 248. The electronic device 101 may further include the processor 120 and the memory 130. The second network 199 may include a first network 292 and a second network 294. According to another embodiment, the electronic device 101 may further include at least one component of the components illustrated in FIG. 1, and the second network 199 may further include at least another network. According to an embodiment, the first communication processor 212, the second communication processor 214, the first RFIC 222, the second RFIC 224, the fourth RFIC 228, the first RFFE 232, and the second RFFE 234 may form at least a portion of the wireless communication module 192. According to another embodiment, the fourth RFIC 228 may be omitted or may be included as a portion of the third RFIC 226.

The first communication processor 212 may establish a communication channel for a band to be used for wireless communication with the first network 292 and may support legacy network communication through the established communication channel. According to various embodiments, the first network 292 may be a legacy network including a $2^{nd}$ generation (2G), $3^{rd}$ generation (3G), $4^{th}$ generation (4G), or long term evolution (LTE) network. The second communication processor 214 may establish a communication channel corresponding to a specified band (e.g., ranging from approximately 6 GHz to approximately 60 GHz) of bands to be used for wireless communication with the second network 294 and may support 5G network communication through the established communication channel. According to various embodiments, the second network 294 may be a 5G network defined in the 3GPP. Additionally, according to an embodiment, the first communication processor 212 or the second communication processor 214 may establish a communication channel corresponding to another specified band (e.g., approximately 6 GHz or lower) of the bands to be used for wireless communication with the second network 294 and may support 5G network communication through the established communication channel. According to an embodiment, the first communication processor 212 and the second communication processor 214 may be implemented in a single chip or a single package. According to various embodiments, the first communication processor 212 or the second communication processor 214 may be implemented in a single chip or a single package together with the processor 120, the auxiliary processor 123, or the communication module 190.

In the case of transmitting a signal, the first RFIC 222 may convert a baseband signal generated by the first communication processor 212 into a radio frequency (RF) signal of approximately 700 MHz to approximately 3 GHz that is used in the first network 292 (e.g., a legacy network). In the case of receiving a signal, an RF signal may be obtained from the first network 292 (e.g., a legacy network) through an antenna (e.g., the first antenna module 242) and may be pre-processed through an RFFE (e.g., the first RFFE 232). The first RFIC 222 may convert the preprocessed RF signal into a baseband signal so as to be processed by the first communication processor 212.

In the case of transmitting a signal, the second RFIC 224 may convert a baseband signal generated by the first communication processor 212 or the second communication processor 214 into an RF signal (hereinafter referred to as a "5G Sub6 RF signal") in a Sub6 band (e.g., approximately 6 GHz or lower) used in the second network 294 (e.g., a 5G network). In the case of receiving a signal, the 5G Sub6 RF signal may be obtained from the second network 294 (e.g., a 5G network) through an antenna (e.g., the second antenna module 244) and may be pre-processed through an RFFE (e.g., the second RFFE 234). The second RFIC 224 may convert the preprocessed 5G Sub6 RF signal into a baseband signal so as to be processed by a corresponding communication processor from among the first communication processor 212 or the second communication processor 214.

The third RFIC 226 may convert the baseband signal generated by the second communication processor 214 into an RF signal (hereinafter referred to as a "5G Above6 RF signal") in a 5G Above6 band (e.g., approximately 6 GHz to approximately 60 GHz) to be used in the second network 294 (e.g., a 5G network). In the case of receiving a signal, the 5G Above6 RF signal may be obtained from the second network 294 (e.g., a 5G network) through an antenna (e.g., the antenna 248) and may be pre-processed through a third RFFE 236. The third RFIC 226 may convert the pre-processed 5G Above6 RF signal into a baseband signal so as to be processed by the second communication processor 214. According to an embodiment, the third RFFE 236 may be implemented as a portion of the third RFIC 226.

According to an embodiment, the electronic device 101 may include the fourth RFIC 228 independently of the third RFIC 226 or as at least a portion of the third RFIC 226. In this case, the fourth RFIC 228 may convert the baseband signal generated by the second communication processor 214 into an RF signal (hereinafter referred to as an "IF signal") in an intermediate frequency band (e.g., approximately 9 GHz to approximately 11 GHz) and may provide the IF signal to the third RFIC 226. The third RFIC 226 may convert the IF signal into the 5G Above6 RF signal. In the case of receiving a signal, the 5G Above6 RF signal may be received from the second network 294 (e.g., a 5G network) through an antenna (e.g., the antenna 248) and may be converted into an IF signal by the third RFIC 226. The fourth RFIC 228 may convert the IF signal into a baseband signal so as to be processed by the second communication processor 214.

According to an embodiment, the first RFIC 222 and the second RFIC 224 may be implemented as a portion of a single package or a single chip. According to an embodiment, the first RFFE 232 and the second RFFE 234 may be implemented as a portion of a single package or a single chip. According to an embodiment, at least one of the first antenna module 242 or the second antenna module 244 may be omitted or may be combined with any other antenna module to process RF signals in a plurality of bands.

According to an embodiment, the third RFIC 226 and the antenna 248 may be disposed at the same substrate to form a third antenna module 246. For example, the wireless communication module 192 or the processor 120 may be disposed at a first substrate (e.g., a main PCB). In this case, the third RFIC 226 may be disposed in a partial region (e.g., on a lower surface) of a second substrate (e.g., a sub PCB) independent of the first substrate, and the antenna 248 may be disposed in another partial region (e.g., on an upper surface) of the second substrate. As such, the third antenna module 246 may be formed. According to an embodiment, the antenna 248 may include, for example, an antenna array to be used for beamforming. As the third RFIC 226 and the antenna 248 are disposed at the same substrate, it may be possible to decrease a length of a transmission line between the third RFIC 226 and the antenna 248. The decrease in the transmission line may make it possible to reduce the loss (or attenuation) of a signal in a high-frequency band (e.g., approximately 6 GHz to approximately 60 GHz) used for the 5G network communication, due to the transmission line. As such, the electronic device 101 may improve the quality or speed of communication with the second network 294 (e.g., a 5G network).

The second network 294 (e.g., a 5G network) may be used independently of the first network 292 (e.g., a legacy network) (e.g., stand-alone (SA)) or may be used in conjunction with the first network 292 (e.g., non-stand alone (NSA)). For example, only an access network (e.g., a 5G radio access network (RAN) or a next generation RAN (NG RAN)) may be present in the 5G network, and a core network (e.g., a next generation core (NGC)) may be absent from the 5G network. In this case, the electronic device 101 may access the access network of the 5G network and may then access an external network (e.g., Internet) under control of a core network (e.g., an evolved packed core (EPC)) of the legacy network. Protocol information (e.g., LTE protocol information) for communication with the legacy network or protocol information (e.g., New Radio (NR) protocol information) for communication with the 5G network may be stored in the memory 130 so as to be accessed by any other component (e.g., the processor 120, the first communication processor 212, or the second communication processor 214).

Figure 3A:
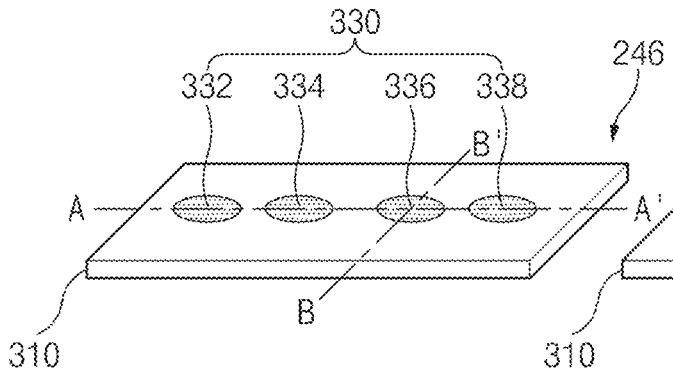
FIGS. 3A, 3B, and 3C are diagrams illustrating a third antenna module described with reference to FIG. 2 according to various embodiments of the disclosure.
Figure 3B:
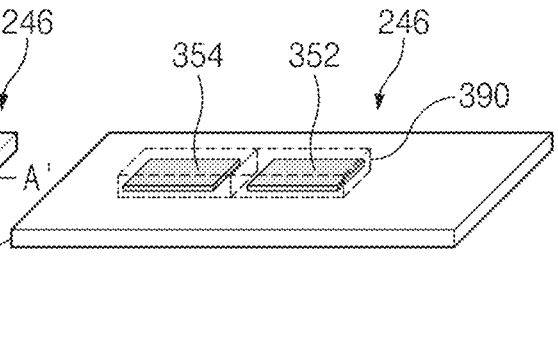
Figure 3C:
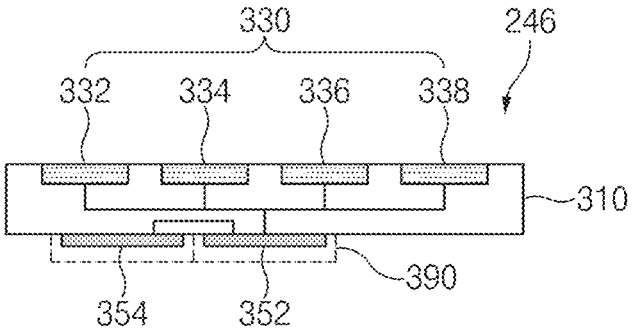

FIGS. 3A, 3B, and 3C illustrate an embodiment of the third antenna module 246 described with reference to FIG. 2 according to various embodiments of the disclosure. FIG. 3A is a perspective view of the third antenna module 246 when viewed from one side, and FIG. 3B is a perspective view of the third antenna module 246 when viewed from another side. FIG. 3C is a cross-sectional view of the third antenna module 246 taken along a line A-A' of FIG. 3A.

Referring to FIGS. 3A, 3B, and 3C, in an embodiment, the third antenna module 246 may include a printed circuit board 310, an antenna array 330, a radio frequency integrated circuit (RFIC) 352, a power management integrated circuit (PMIC) 354, and a module interface. Selectively, the third antenna module 246 may further include a shielding member 390. In various embodiments, at least one of the above components may be omitted, or at least two of the components may be integrally formed.

The printed circuit board 310 may include a plurality of conductive layers and a plurality of non-conductive layers, and the conductive layers and the non-conductive layers may be alternately stacked. The printed circuit board 310 may provide electrical connection with various electronic components disposed on the printed circuit board 310 or on the outside, by using wires and conductive vias formed in the conductive layers.

The antenna array 330 (e.g., 248 of FIG. 2) may include a plurality of antenna elements 332, 334, 336, and 338 disposed to form a directional beam. The antenna elements 332, 334, 336, and 338 may be formed on a first surface of the printed circuit board 310 as illustrated. According to another embodiment, the antenna array 330 may be formed within the printed circuit board 310. According to embodiments, the antenna array 330 may include a plurality of antenna arrays (e.g., at least one of a dipole antenna array or a patch antenna array) that are identical or different in shape or kind.

The RFIC 352 (e.g., 226 of FIG. 2) may be disposed in another region (e.g., on a second surface facing away from the first surface) of the printed circuit board 310 so as to be spaced from the antenna array 330. The RFIC 352 may be configured to process a signal in a selected frequency band, which is transmitted/received through the antenna array 330. According to an embodiment, in the case of transmitting a signal, the RFIC 352 may convert a baseband signal obtained from a communication processor (not illustrated) into an RF signal. In the case of receiving a signal, the RFIC 352 may convert an RF signal received through the antenna array 330 into a baseband signal and may provide the baseband signal to the communication processor.

According to another embodiment, in the case of transmitting a signal, the RFIC 352 may up-convert an IF signal (e.g., approximately 9 GHz to approximately 11 GHz) obtained from an intermediate frequency integrated circuit (IFIC) (e.g., 228 of FIG. 2) into an RF signal. In the case of receiving a signal, the RFIC 352 may down-convert an RF signal obtained through the antenna array 330 into an IF signal and may provide the IF signal to the IFIC.

The PMIC 354 may be disposed in another region (e.g., on the second surface) of the printed circuit board 310, which is spaced from the antenna array 330. The PMIC 354 may be supplied with a voltage from a main PCB (not illustrated) and may provide power used for various components (e.g., the RFIC 352) on an antenna module.

The shielding member 390 may be disposed at a portion (e.g., on the second surface) of the printed circuit board 310 such that at least one of the RFIC 352 or the PMIC 354 is electromagnetically shielded. According to an embodiment, the shielding member 390 may include a shield can.

Although not illustrated in drawings, in various embodiments, the third antenna module 246 may be electrically connected with another printed circuit board (e.g., a main circuit board) through a module interface. The module interface may include a connection member, for example, a coaxial cable connector, a board to board connector, an interposer, or a flexible printed circuit board (FPCB). At least one of the RFIC 352 or the PMIC 354 of the third antenna module 246 may be electrically connected with the printed circuit board through the connection member.

Figure 4:
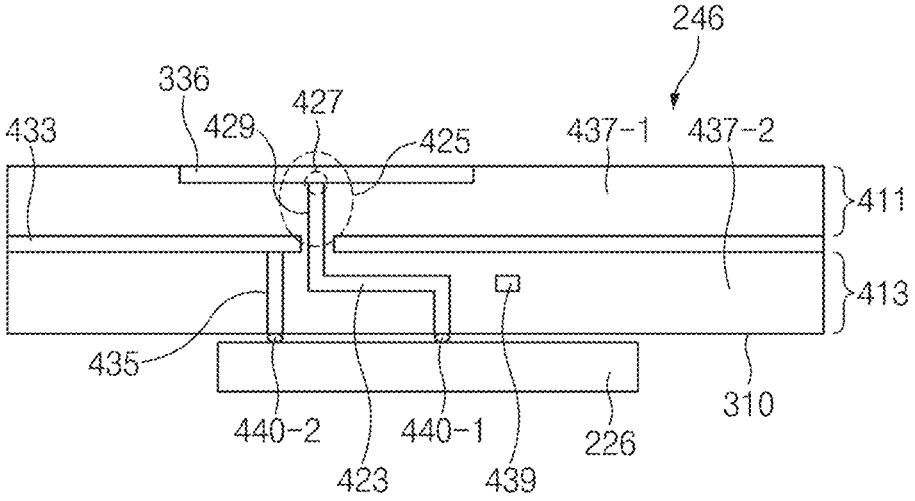
FIG. 4 illustrates a cross-sectional view of a third antenna module taken along a line A-A' of FIG. 3A according to an embodiment of the disclosure.

FIG. 4 illustrates a cross-sectional view of the third antenna module 246 taken along a line A-A' of FIG. 3A according to an embodiment of the disclosure. In an embodiment illustrated, the printed circuit board 310 may include an antenna layer 411 and a network layer 413.

The antenna layer 411 may include at least one of at least one dielectric layer 437-1, an antenna element 336 or a feeding part 425 formed on an outer surface of the dielectric layer 437-1 or therein. The feeding part 425 may include at least one of a feeding point 427 or a feeding line 429.

The network layer 413 may include at least one of at least one dielectric layer 437-2, at least one ground layer 433, at least one conductive via 435, a transmission line 423, or a signal line 439 formed on an outer surface of the dielectric layer 437-2 or therein.

In addition, in the embodiment illustrated, the third RFIC 226 of FIG. 3C may be electrically connected with the network layer 413, for example, through first and second connection parts (e.g., solder bumps) 440-1 and 440-2. In various embodiments, various connection structures (e.g., soldering or a ball grid array (BGA)) may be utilized instead of the connection parts 440-1 and 440-2. The third RFIC 226 may be electrically connected with the antenna element 336 through the first connection part 440-1, the transmission line 423, and the feeding part 425. Also, the third RFIC 226 may be electrically connected with the ground layer 433 through the second connection part 440-2 and the conductive via 435. Although not illustrated in drawings, the third RFIC 226 may also be electrically connected with the above module interface through the signal line 439.

Figure 5:
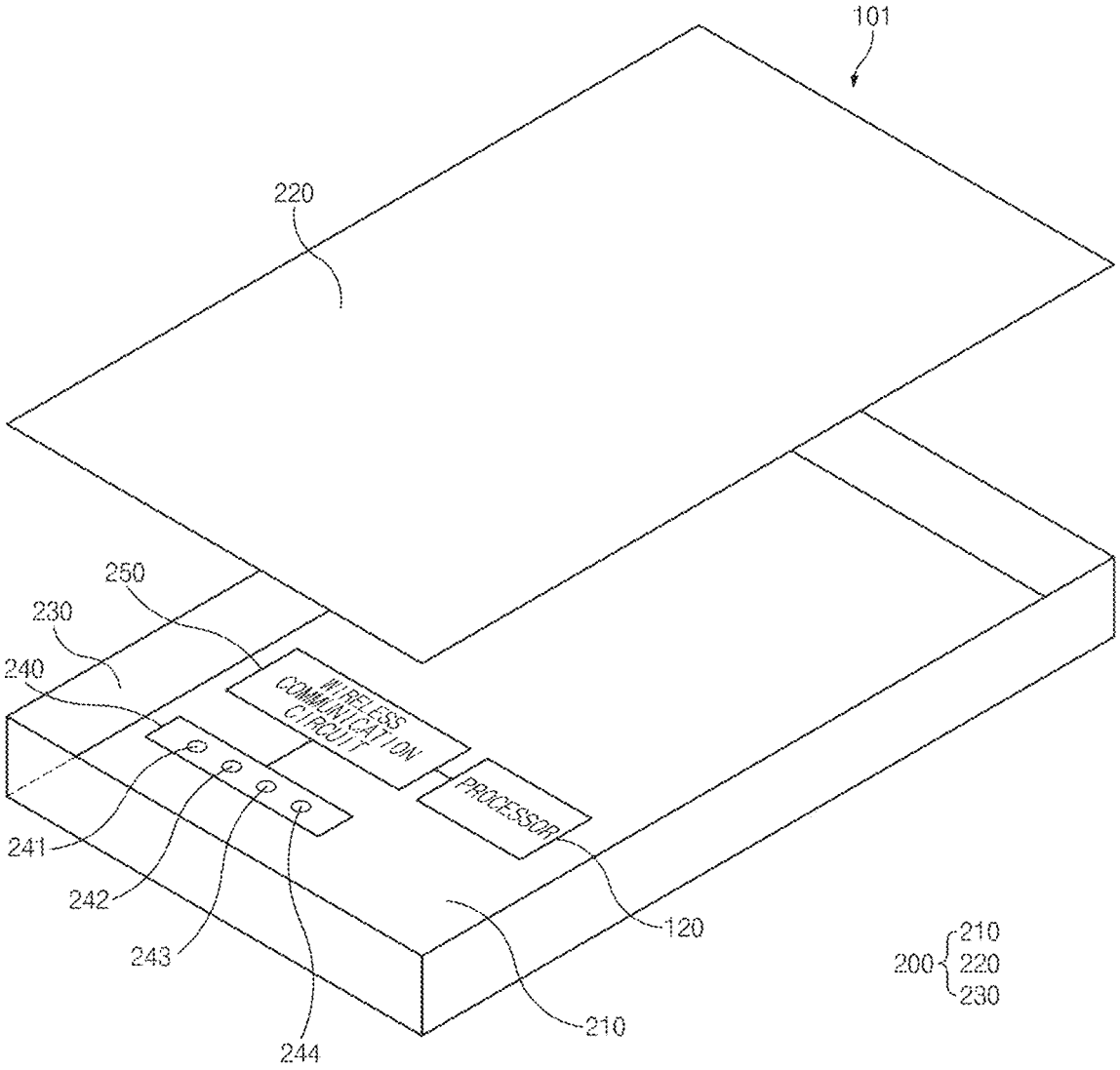
FIG. 5 is a diagram illustrating at least one of a housing, an antenna structure, a wireless communication circuit, or a processor of an electronic device according to an embodiment of the disclosure.

FIG. 5 is a diagram illustrating at least one of a housing 200, an antenna structure 240, a wireless communication circuit 250, or the processor 120 of the electronic device 101 according to an embodiment of the disclosure.

In an embodiment, the housing 200 may include at least one of a first plate 210, a second plate 220, or a side member 230.

In an embodiment, the first plate 210 may form a first surface (or a front surface) of the electronic device 101. At least a portion of the first plate 210 may be substantially transparent. For example, the first plate 210 may be formed of a polymer plate, or a glass plate including various coating layers. A display of the display device 160 may be exposed through a substantially transparent portion of the first surface of the first plate 210.

In an embodiment, the second plate 220 may form a second surface (or a back surface) of the electronic device 101. The second plate 220 may be formed to face away from the first plate 210. In an embodiment, the second plate 220 may be substantially opaque. For example, the second plate 220 may be formed of a coated or colored glass, a ceramic, a polymer, a metal (e.g., aluminum, stainless steel (STS), or magnesium), or a combination of at least two of the materials.

In an embodiment, the side member 230 may form a side surface that surrounds a space between the first plate 210 and the second plate 220 of the electronic device 101. The side member 230 may surround the space between the first plate 210 and the second plate 220. The side member 230 may be connected to the second plate 220. For example, the side member 230 may be coupled to the first plate 210 and the second plate 220 and may have a side bezel structure including at least one of metal or polymer. For another example, the side member 230 may be integrally formed with the second plate 220 and may include the same material (e.g., a metal material such as aluminum) as the second plate 220.

In an embodiment, the antenna structure 240 may be disposed within the housing 200. For example, the antenna structure 240 may be attached to at least a portion of an inner edge of the housing 200. The antenna structure 240 may include a plurality of conductive patches 241 to 244. The plurality of conductive patches 241 to 244 may include, for example, at least one of the first conductive patch 241, the second conductive patch 242, the third conductive patch 243, or the fourth conductive patch 244. The antenna structure 240 may at least one of transmit or receive an RF signal by using the plurality of conductive patches 241 to 244.

In an embodiment, the wireless communication circuit 250 may be connected to the antenna structure 240. The wireless communication circuit 250 may include at least one of a radio frequency integrated circuit (RFIC), an inter frequency integrated circuit (IFIC), or a communication processor (CP). The wireless communication circuit 250 may at least one of transmit or receive a signal of a specified frequency.

In an embodiment, the processor 120 may be operatively connected to the wireless communication circuit 250. The processor 120 may include an application processor (AP) or a communication processor (CP). The processor 120 may control an operation of the wireless communication circuit 250.

In an embodiment, the plurality of conductive patches 241 to 244 may be disposed within the antenna structure 240 or on one surface of the antenna structure 240. Referring to FIG. 5 as the four conductive patches 241 to 244 are arranged in the antenna structure 240. However, the disclosure is not limited thereto. For example, the antenna structure 240 may include five or more conductive patches or three or less conductive patches. Each of the plurality of conductive patches 241 to 244 may be in the shape of a circle or a polygon, but the disclosure is not limited thereto. The plurality of conductive patches 241 to 244 may be arranged on the antenna structure 240 at regular intervals. The plurality of conductive patches 241 to 244 may at least one of transmit or receive an RF signal.

Figure 6:
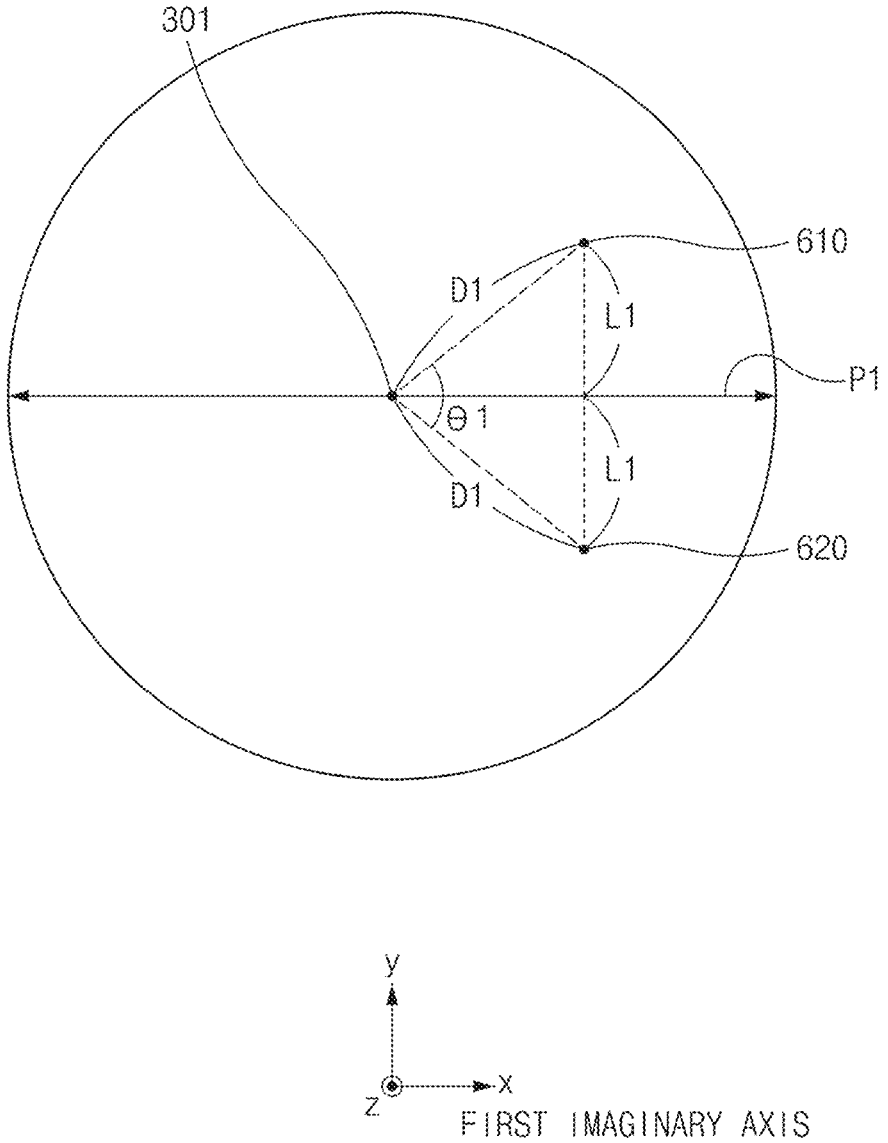
FIG. 6 is a diagram illustrating a first conductive patch, a first position, and a second position according to an embodiment of the disclosure.

FIG. 6 is a diagram illustrating the first conductive patch 241, a first position 610, and a second position 620 according to an embodiment of the disclosure. The first position 610 may be a point on the first conductive patch 241, to which a first port is connected. The second position 620 may be a point on the first conductive patch 241, to which a second port is connected.

In an embodiment, the wireless communication circuit 250 may include the first port and the second port. Transmission lines such as a feeding line may be extended from the first port and the second port. The transmission line may be connected to the first position 610 or the second position 620 on the first conductive patch 241. The transmission line may be a path connecting the wireless communication circuit 250 and a feeding part of the first conductive patch 241.

In an embodiment, the first port and the second port may be connected to the first position 610 or the second position 620 through various electrical paths. For example, the first port and the second port may be connected to the first position 610 or the second position 620 through a conductive contact formed on one surface of the first conductive patch 241, a via hole formed to face the one surface of the first conductive patch 241 from the wireless communication circuit 250, one end of a transmission line extended to face the one surface of the first conductive patch 241 from the wireless communication circuit 250, or a conductive pattern included in a conductive layer of a printed circuit board (PCB), which forms the antenna structure 240 including the first conductive patch 241.

In an embodiment, the first conductive patch 241 may be a defined central point 301. The central point 301 may be defined depending on a shape of the first conductive patch 241. For example, in the case where the first conductive patch 241 is circular, the central point 301 may be defined to correspond to the center of the first conductive patch 241. For another example, in the case where the first conductive patch 241 is polygonal, the central point 301 may be defined to correspond to a central point at which physical lengths or electrical lengths from edges of the first conductive patch 241 to the center of the first conductive patch 241 are identical.

In an embodiment, the wireless communication circuit 250 may include the first port and the second port. The wireless communication circuit 250 may feed the first conductive patch 241 through the first port and the second port such that the first conductive patch 241 radiates an RF signal.

In an embodiment, the first port may be connected to the first position 610 on the first conductive patch 241. The first position 610 may be spaced from the central point 301 of the first conductive patch 241 as much as a first distance D1. The first distance D1 may be determined depending on an impedance of the first conductive patch 241.

In an embodiment, the second port may be connected to the second position 620 on the first conductive patch 241. The second position 620 may be different in point from the first position 610. The second position 620 may be spaced from the central point 301 of the first conductive patch 241 as much as the first distance D1.

In an embodiment, the wireless communication circuit 250 may feed the first conductive patch 241 by using the first port and the second port. The wireless communication circuit 250 may feed the first position 610 and the second position 620 to generate a first polarization (or polarized wave) P1 on the first conductive patch 241.

In an embodiment, the first polarization P1 may be formed in a first imaginary axis (x-axis) direction. The first conductive patch 241 may at least one of transmit or receive a signal polarized in the first imaginary axis (x-axis) direction. Signals belonging to a +y axis direction and a −y axis direction from among signals fed to the first position 610 and the second position 620 may be canceled out, and the remaining signal in a +x or −x axis direction may be at least one of transmitted or received. The first polarization P1 may be referred to as a "horizontal polarization". For example, in the case where signals that the wireless communication circuit 250 feeds to the first port and the second port are identical in magnitude and phase, the first polarization P1 may be formed to pass a central point of the first position 610 and the second position 620 in the first imaginary axis (x-axis) direction.

In an embodiment, the first position 610 and the second position 620 may be disposed to be symmetrical with respect to the first imaginary axis (x-axis) passing the central point 301 in parallel with a direction of the first polarization P1. The first position 610 and the second position 620 may be spaced from the first imaginary axis (x-axis) as much as the same length. In this case, the first position 610 may be spaced from the first imaginary axis (x-axis) in the +y axis direction as much as a first length L1. The second position 620 may be spaced from the first imaginary axis (x-axis) in the −y axis direction as much as the first length L1.

In an embodiment, a line connecting the central point 301 and the first position 610 and a line connecting the central point 301 and the second position 620 may be disposed such that an included angle in the first imaginary axis (x-axis) direction is an acute angle. An imaginary straight line connecting the first position 610 and the central point 301 and an imaginary straight line connecting the second position 620 and the central point 301 may cross each other at the central point 301 with a first angle θ1. The first angle θ1 may be 0 degree or more and 90 degrees or less.

In an embodiment, signals that the wireless communication circuit 250 feeds to the first position 610 and the second position 620 of the first conductive patch 241 may be identical in magnitude and phase. In the case where signals that the wireless communication circuit 250 feeds to the first position 610 and the second position 620 are identical in magnitude and phase, the first polarization P1 may be generated in the same direction as the case where the wireless communication circuit 250 connects a single port to a single position on the first imaginary axis (x-axis) to feed the first conductive patch 241.

In an embodiment, the first position 610 and the second position 620 may be spaced from the central point 301 as much as the first distance D1. An impedance of the first conductive patch 241 when the first conductive patch 241 is fed at the first position 610 and the second position 620 by using the first port and the second port of the wireless communication circuit 250 may be different in value from an impedance of the first conductive patch 241 when the first conductive patch 241 is fed at a single position by using a single port of the wireless communication circuit 250. For example, in the case of needing to decrease the impedance of the first conductive patch 241 when the first conductive patch 241 is fed at the first position 610 and the second position 620 compared with when the first conductive patch 241 is fed at a single position, the first distance D1 may be shorter than a distance by which the single position is spaced from the central point 301 when the first conductive patch 241 is connected with the single port.

Figure 7:
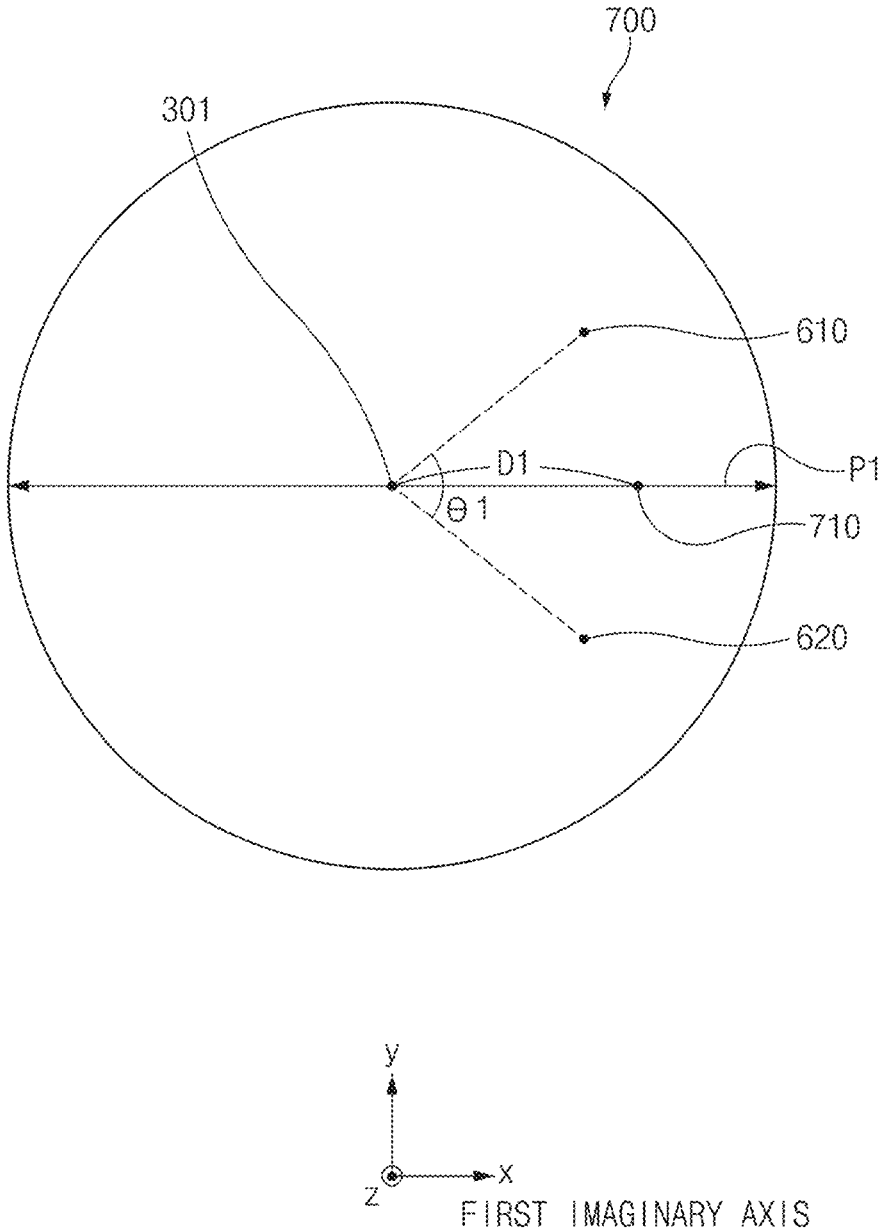
FIG. 7 is a diagram illustrating positions where a conductive patch is connected with a plurality of ports, according to an embodiment of the disclosure.

FIG. 7 is a diagram illustrating positions 610, 620, and 710 where a conductive patch 700 is connected with a plurality of ports, according to an embodiment of the disclosure.

In an embodiment, the conductive patch 700 may include at least one of the central point 301, the first position 610, the second position 620, or the third position 710. The central point 301, the first position 610, and the second position 620 of the conductive patch 700 of FIG. 7 are substantially identical to the central point 301, the first position 610, and the second position 620 of the first conductive patch 241 of FIG. 6, and thus, additional description will be omitted to avoid redundancy.

In an embodiment, the wireless communication circuit 250 may feed at least one of a first port, a second port, or a third port such that the conductive patch 700 radiates an RF signal. The first port may be connected to the first position 610 on the conductive patch 700 through a transmission line. The second port may be connected to the second position 620 on the conductive patch 700 through a transmission line.

In an embodiment, the third port may be connected to the third position 710 on the conductive patch 700. The third position 710 may be different in point from the first position 610 and the second position 620. The third position 710 may be spaced from the central point 301 of the conductive patch 700 as much as the first distance D1.

In an embodiment, the wireless communication circuit 250 may feed the conductive patch 700 by using at least one of the first port, the second port, or the third port. The wireless communication circuit 250 may feed the first position 610, the second position 620, and the third position 710 to generate the first polarization P1 on the conductive patch 700.

In an embodiment, the wireless communication circuit 250 may feed signals with the same magnitude and the same phase to the first port, the second port, and the third port, the number of which is odd-numbered, to form the first polarization P1. The first polarization P1 may be formed in a direction that passes both the central point of the first position 610 and the second position 620 and the third position 710. The wireless communication circuit 250 may connect at least one of odd-numbered ports to the third position 710 disposed on the first imaginary axis (x-axis) parallel to the direction of the first polarization P1 and may form the first polarization P1.

In an embodiment, the third position 710 may be disposed on the first imaginary axis (x-axis). An imaginary straight line connecting the first position 610 and the central point 301 and an imaginary straight line connecting the second position 620 and the central point 301 may cross each other at the central point 301 with the first angle θ1. The first angle θ1 may be 0 degree or more and 90 degrees or less.

Figure 8:
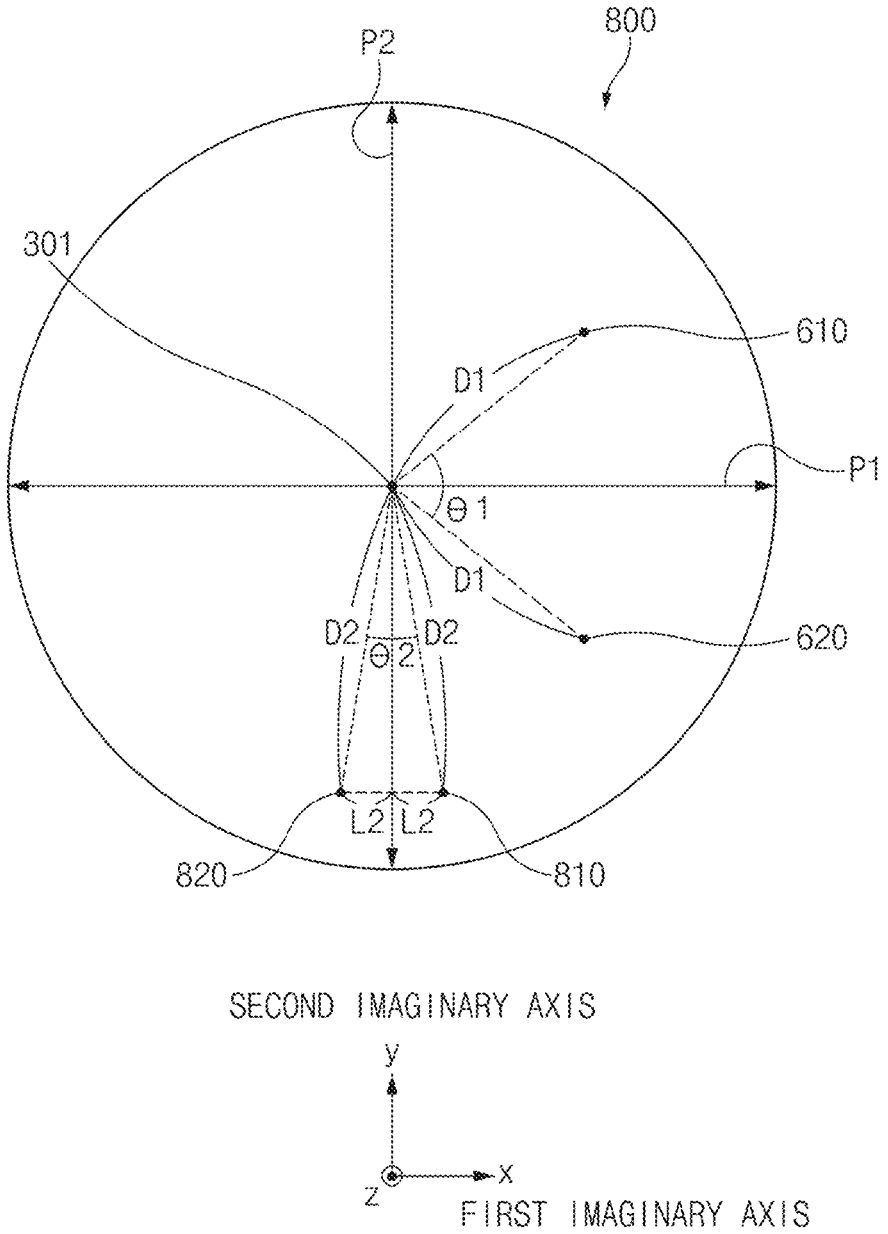
FIG. 8 is a diagram illustrating positions where a conductive patch is connected with a plurality of ports, according to an embodiment of the disclosure.

FIG. 8 is a diagram illustrating positions 610, 620, 810, and 820 where a conductive patch 800 is connected with a plurality of ports, according to another embodiment of the disclosure.

In an embodiment, the conductive patch 800 may include at least one of the central point 301, the first position 610, the second position 620, a fourth position 810, or a fifth position 820. The central point 301, the first position 610, and the second position 620 of the conductive patch 800 of FIG. 8 are substantially identical to the central point 301, the first position 610, and the second position 620 of the conductive patch 700 of FIG. 7, and thus, additional description will be omitted to avoid redundancy.

In an embodiment, the wireless communication circuit 250 may feed at least one of a first port, a second port, a third port, or a fourth port such that the conductive patch 800 radiates an RF signal. The first port may be connected to the first position 610 on the conductive patch 800 through a transmission line. The second port may be connected to the second position 620 on the conductive patch 800 through a transmission line. The third port may be connected to the fourth position 810 on the conductive patch 800 through a transmission line. The fourth port may be connected to the fifth position 820 on the conductive patch 800 through a transmission line.

In an embodiment, the fourth position 810 and the fifth position 820 of the conductive patch 800 of FIG. 8 may be disposed to be orthogonal to the first position 610 and the second position 620, respectively. The fourth position 810 and the fifth position 820 may form a polarization that is orthogonal to a polarization formed at the first position 610 and the second position 620. The wireless communication circuit 250 may feed at least one of the first position 610, the second position 620, the fourth position 810, or the fifth position 820 such that the conductive patch 800 radiates an RF signal.

In an embodiment, the third port may be connected to the fourth position 810 on the at least one conductive patch 800. The fourth position 810 may be different in point from the first position 610, the second position 620, or the third position 710. The fourth position 810 may be spaced from the central point 301 of the conductive patch 800 as much as a second distance D2.

In an embodiment, the second distance D2 may be determined depending on at least one of a ratio of magnitudes of signals polarized in orthogonal directions, an impedance of the conductive patch 800, or a relationship between frequency bands of signals fed to at least one of the first position 610, the second position 620, the fourth position 810, or the fifth position 820. For example, in the case of at least one of transmitting or receiving signals in the same frequency band at the first and second positions 610 and 620 and the fourth and fifth positions 810 and 820 with different polarizations, the second distance D2 may be set to be identical to the first distance D1, and the first angle θ1 may be set to be identical to a second angle θ2. For another example, in the case of at least one of transmitting or receiving signals in different frequency bands at the first and second positions 610 and 620 and the fourth and fifth positions 810 and 820, the second distance D2 may be set to be different from the first distance D1, and the second angle θ2 may be set to be different from the first angle θ1.

In an embodiment, the fourth port may be connected to the fifth position 820 on the at least one conductive patch 800. The fifth position 820 may be different in point from the first position 610 to the fourth position 810. The fifth position 820 may be spaced from the central point 301 of the conductive patch 800 as much as the second distance D2.

In an embodiment, the wireless communication circuit 250 may feed the first position 610 and the second position 620 to generate the first polarization P1. The wireless communication circuit 250 may feed the fourth position 810 and the fifth position 820 to generate a second polarization P2 orthogonal to the first polarization P1.

In an embodiment, the second polarization P2 may be formed in a direction of a second imaginary axis (y-axis) perpendicular to the first imaginary axis (x-axis). The conductive patch 800 may at least one of transmit or receive a signal polarized in the second imaginary axis (y-axis) direction. Signals belonging to a +x axis direction and a −x axis direction from among signals fed to the fourth position 810 and the fifth position 820 may be offset, and the remaining signal in the +y or −y axis direction may be at least one of transmitted or received. The second polarization P2 may be referred to as a "vertical polarization". For example, in the case where signals that the wireless communication circuit 250 feeds to the third port and the fourth port are identical in magnitude and phase, the second polarization P2 may be formed to pass a central point of the fourth position 810 and the fifth position 820 in the second imaginary axis (y-axis) direction.

In an embodiment, the fourth position 810 and the fifth position 820 may be disposed to be symmetrical with respect to the second imaginary axis (y-axis). The fourth position 810 may be spaced from the second imaginary axis (y-axis) in the +x axis direction as much as a second length L2. The fifth position 820 may be spaced from the second imaginary axis (y-axis) in the −x axis direction as much as the second length L2. In an embodiment, a line connecting the central point 301 and the fourth position 810 and a line connecting the central point 301 and the fifth position 820 may be disposed such that an included angle in the second imaginary axis (y-axis) direction is an acute angle. An imaginary straight line connecting the fourth position 810 and the central point 301 and an imaginary straight line connecting the fifth position 820 and the central point 301 may cross each other at the central point 301 with the second angle θ2. The second angle θ2 may be 0 degree or more and 90 degrees or less.

In an embodiment, signals that the wireless communication circuit 250 feeds to the at least one conductive patch 800 at the third port and the fourth port may be identical in magnitude and phase. In the case where signals that the wireless communication circuit 250 feeds to the fourth position 810 and the fifth position 820 are identical in magnitude and phase, the second polarization P2 may be generated in the same direction as the case where the wireless communication circuit 250 feeds the conductive patch 800 through a single position on the second imaginary axis (y-axis). A relationship such as a ratio of magnitudes of the first polarization P1 and the second polarization P2 may be controlled depending on a magnitude or phase relationship of signals that the wireless communication circuit 250 supplies to the fourth position 810 and the fifth position 820 and signals that the wireless communication circuit 250 supplies to the first position 610 and the second position 620. For example, in the case where a magnitude of the signals that the wireless communication circuit 250 supplies to the fourth position 810 and the fifth position 820 is identical to a magnitude of the signals that the wireless communication circuit 250 supplies to the first position 610 and the second position 620, the first polarization P1 and the second polarization P2 may be controlled to have the same magnitude.

Figure 9:
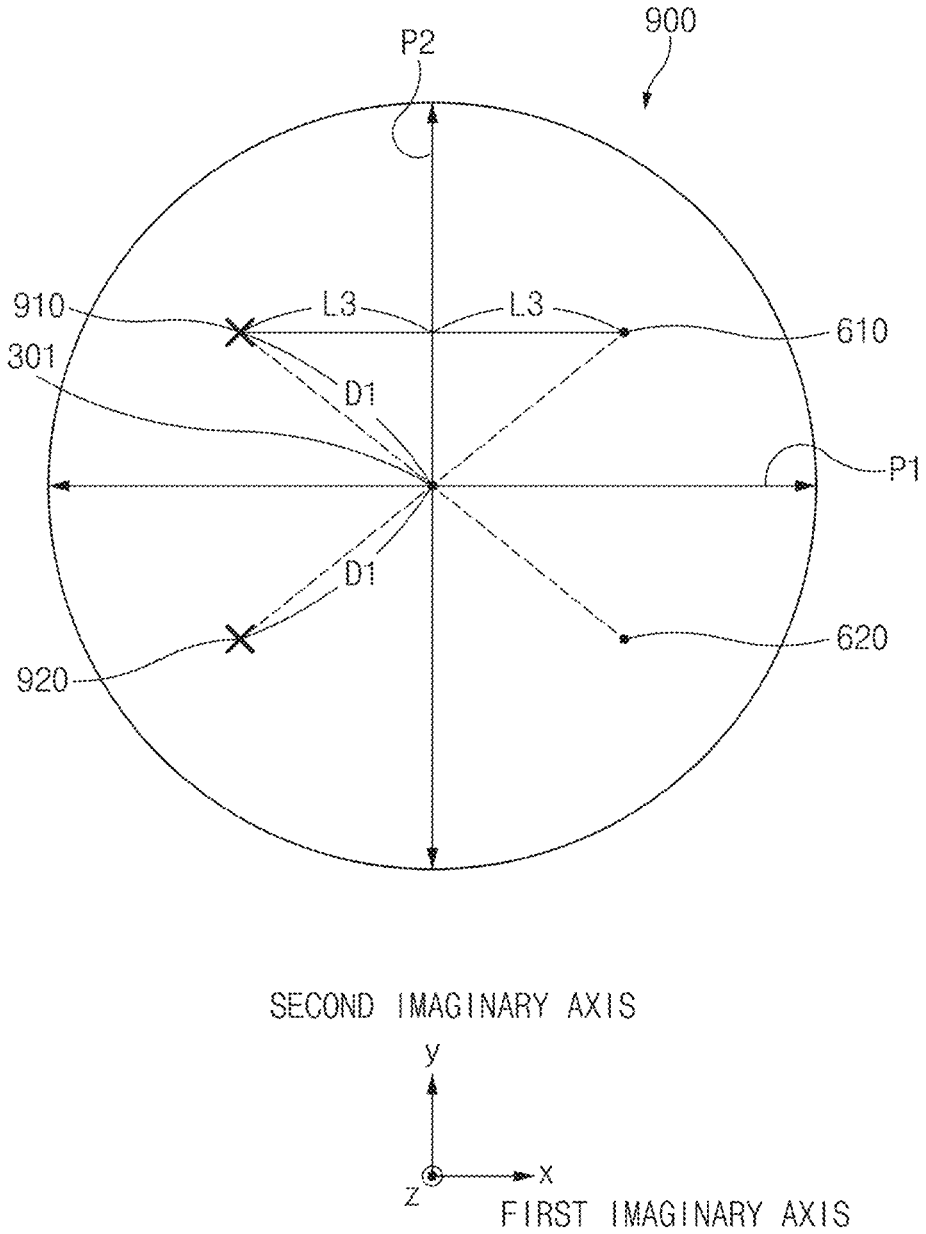
FIG. 9 is a diagram illustrating positions where a conductive patch is connected with a plurality of ports, according to another embodiment of the disclosure.

FIG. 9 is a diagram illustrating positions 610, 620, 910, and 920 where a conductive patch 900 is connected with a plurality of ports, according to another embodiment of the disclosure.

In an embodiment, the conductive patch 900 may include at least one of the central point 301, the first position 610, the second position 620, a sixth position 910, or a seventh position 920. The central point 301, the first position 610, and the second position 620 of the conductive patch 900 of FIG. 9 are substantially identical to the central point 301, the first position 610, and the second position 620 of the conductive patch 800 of FIG. 8, and thus, additional description will be omitted to avoid redundancy.

In an embodiment, the wireless communication circuit 250 may include first to fourth ports. The wireless communication circuit 250 may feed the conductive patch 900 by using at least one of the first port, the second port, the third port, or the fourth port such that the conductive patch 900 radiates an RF signal.

In an embodiment, the third port of the wireless communication circuit 250 may be connected to the sixth position 910 on the conductive patch 900. The sixth position 910 may be different in point from the first position 610, the second position 620, and the seventh position 920. The sixth position 910 may be spaced from the central point 301 of the conductive patch 900 as much as the first distance D1.

In an embodiment, the fourth port of the wireless communication circuit 250 may be connected to the seventh position 920 on the conductive patch 900. The seventh position 920 may be different in point from the first position 610 to the sixth position 910. The seventh position 920 may be spaced from the central point 301 of the conductive patch 900 as much as the first distance D1.

In an embodiment, the wireless communication circuit 250 may feed at least one of the first position 610, the second position 620, the sixth position 910, or the seventh position 920.

In an embodiment, the first position 610 and the sixth position 910 may be disposed to be symmetrical with respect to the second imaginary axis (y-axis) that passes the central point 301 in the direction of the second polarization P2 being perpendicular to the direction of the first polarization P1. The second position 620 and the seventh position 920 may be disposed to be symmetrical with respect to the second imaginary axis (y-axis). The first position 610 and the sixth position 910 may be respectively spaced from the second imaginary axis (y-axis) in the +x axis direction and the −x axis direction as much as a third length L3. The second position 620 and the seventh position 920 may be respectively spaced from the second imaginary axis (y-axis) in the +x axis direction and the −x axis direction as much as the third length L3.

In an embodiment, a phase difference between signals that the wireless communication circuit 250 feeds to the conductive patch 900 through the third port and the fourth port and signals that the wireless communication circuit 250 feeds to the conductive patch 900 through the first port and the second port may be 180 degrees. The wireless communication circuit 250 may perform differential feeding in which a phase of the signals fed to the first position 610 and the second position 620 is opposite to a phase of the signals fed to the sixth position 910 and the seventh position 920.

Figure 10A:
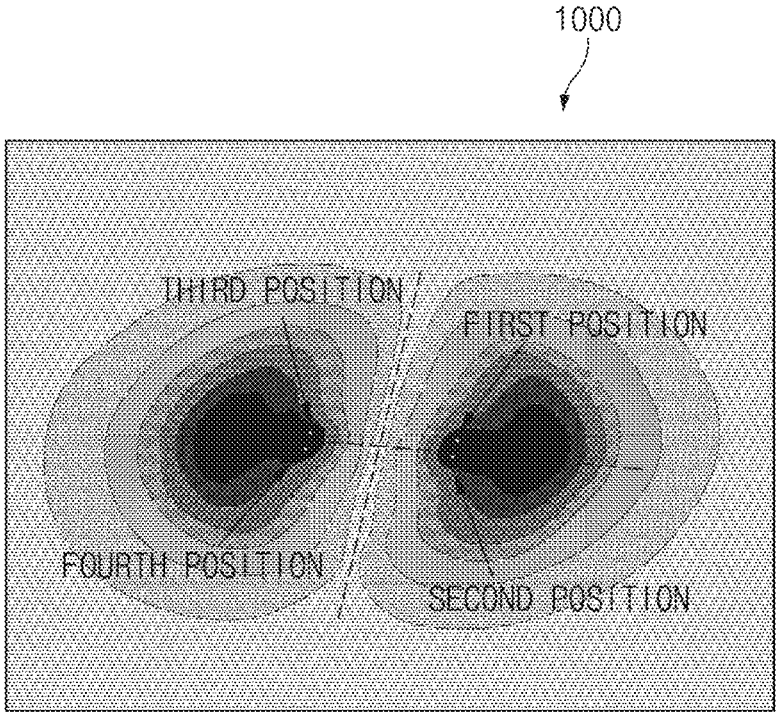
FIG. 10A is a diagram illustrating an electric field distribution of a conductive patch according to an embodiment of the disclosure.

FIG. 10A is a diagram 1000 illustrating an electric field distribution of a conductive patch (e.g., the conductive patch 900 of FIG. 9) according to an embodiment of the disclosure.

In an embodiment, an electric field (E-field) distributed on the conductive patch 900 may be simulated. The wireless communication circuit 250 may feed the conductive patch 900 by using the first port to the fourth port. The wireless communication circuit 250 may differently set signals applied to the first port and the second port and signals applied to the third port and the fourth port so as to have a phase difference of 180 degrees.

In an embodiment, signals having a phase difference of 180 degrees may be fed to the first and second positions 610 and 620 and the sixth and seventh positions 910 and 920. When feeding the conductive patch 900, an absolute value of an electric field or a distribution current may be shown for each area, compared with a ground GND of the antenna structure 240.

In an embodiment, electric fields or distribution currents may be symmetrical with respect to the first imaginary axis (x-axis). The conductive patch 900 may be uniformly fed even in the case of applying both the multi feeding and the differential feeding by using the first port to the fourth port. For another example, as the electric field or distribution current of the conductive patch 900 is uniform, the resonance in the conductive patch 900 may be easily made.

Figure 10B:
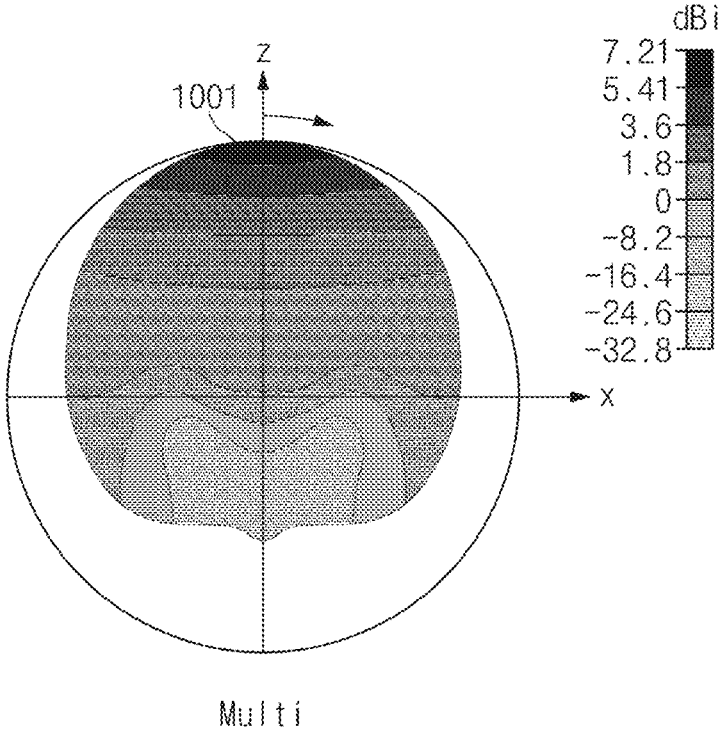
FIG. 10B is a diagram illustrating a pattern of a signal that a conductive patch radiates, according to an embodiment of the disclosure.

FIG. 10B is a diagram illustrating a pattern of a signal 1001 that a conductive patch (e.g., the conductive patch 900 of FIG. 9) radiates, according to an embodiment of the disclosure.

In an embodiment, when the conductive patch 900 is fed, the conductive patch 900 may radiate the signal 1001. The conductive patch 900 may radiate the signal 1001 toward one surface. For example, in the case where the conductive patch 900 is disposed parallel to an x-y plane, the conductive patch 900 may radiate the signal 1001 in the z-axis direction.

In an embodiment, the conductive patch 900 may radiate the signal 1001 at the central point 301 in a direction parallel to the z-axis direction. When the conductive patch 900 is multiple-fed, a radiation performance of the signal 1001 in the z-axis direction may be improved compared to the case where the conductive patch 900 is fed through a single port. For example, in the conductive patch 900, a peak magnitude of the signal 1001 in the z-axis direction may increase. For example, as illustrated in FIG. 10B, the magnitude of the signal 1001 in the z-axis direction may increase up to approximately 7.21 dBi.

In an embodiment, in the case of the multi feeding, the output strength of the signal 1001 may increase. For example, in the case where the feeding is performed at four positions by using the first to fourth ports, there may be four feeding points. In the case where two feeding points exist, the output strength of the signal 1001 may increase as much as approximately 3 dB compared to the case where one feeding point exists. As such, in the case where four feeding points exist, the output strength of the signal 1001 may increase as much as approximately 6 dB compared to the case where one feeding point exists.

Figure 11:
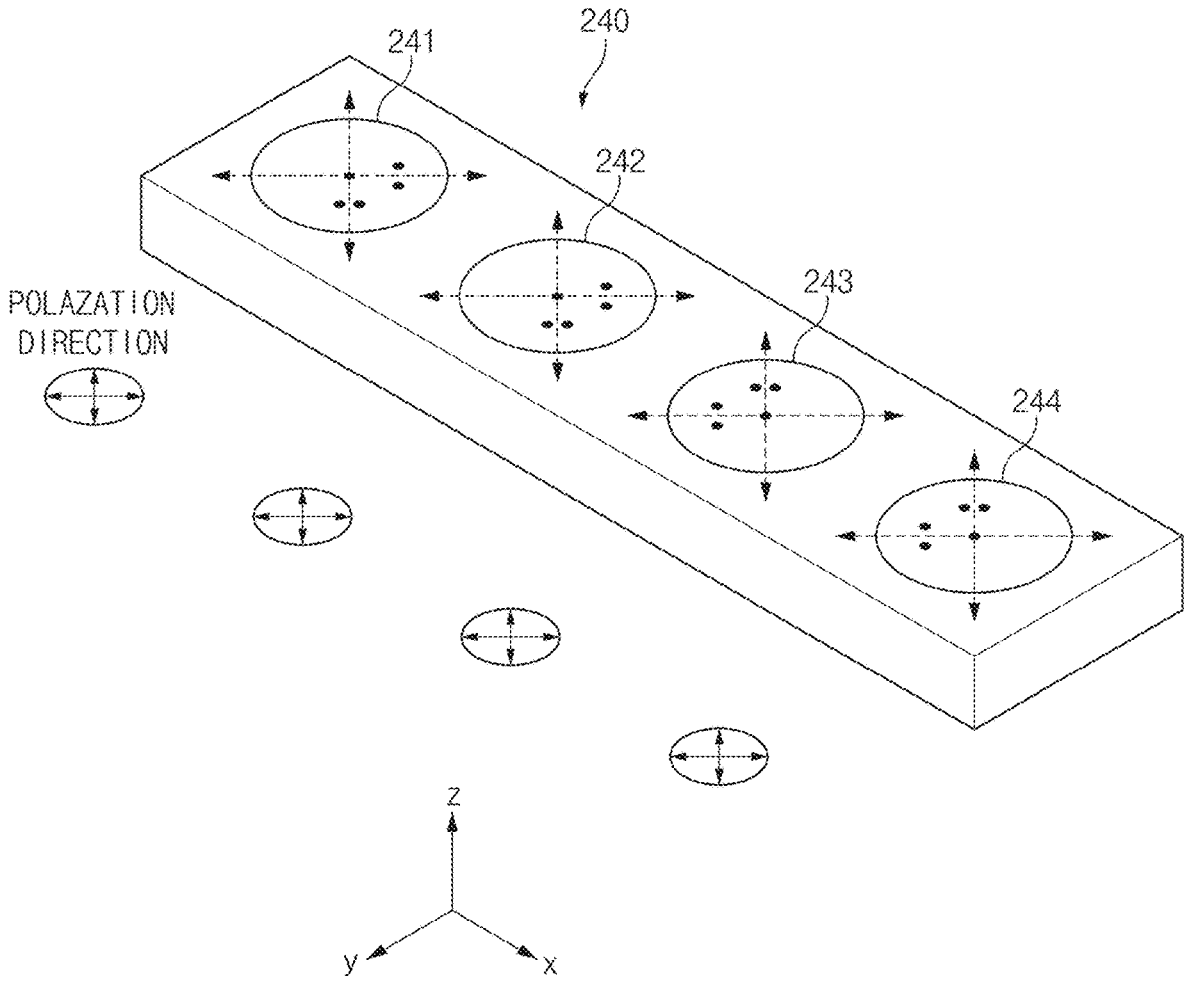
FIG. 11 is a diagram illustrating an antenna structure and a plurality of conductive patches according to an embodiment of the disclosure.

FIG. 11 is a diagram illustrating the antenna structure 240 and the plurality of conductive patches 241 to 244 according to an embodiment of the disclosure. The case where the first conductive patch 241 to the fourth conductive patch 244 are arranged in line is illustrated in FIG. 11.

In an embodiment, physical structures and feeding structures of the first conductive patch 241 to the fourth conductive patch 244 may be substantially identical. The first conductive patch 241 to the fourth conductive patch 244 may be connected with a same number of ports. For example, each of the first conductive patch 241 to the fourth conductive patch 244 may have a feeding structure including a total of four feeding points. In this case, the wireless communication circuit 250 may have four feeding parts per conductive patch. In the case where all the feeding parts of each conductive patch are individually connected with the wireless communication circuit 250, the four feeding parts disposed at each of the first conductive patch 241 to the fourth conductive patch 244, that is, a total of 16 feeding parts may be connected with the wireless communication circuit 250. The wireless communication circuit 250 may feed signals to 16 feeding points by using transmission lines respectively extended from 16 ports.

Figure 15:
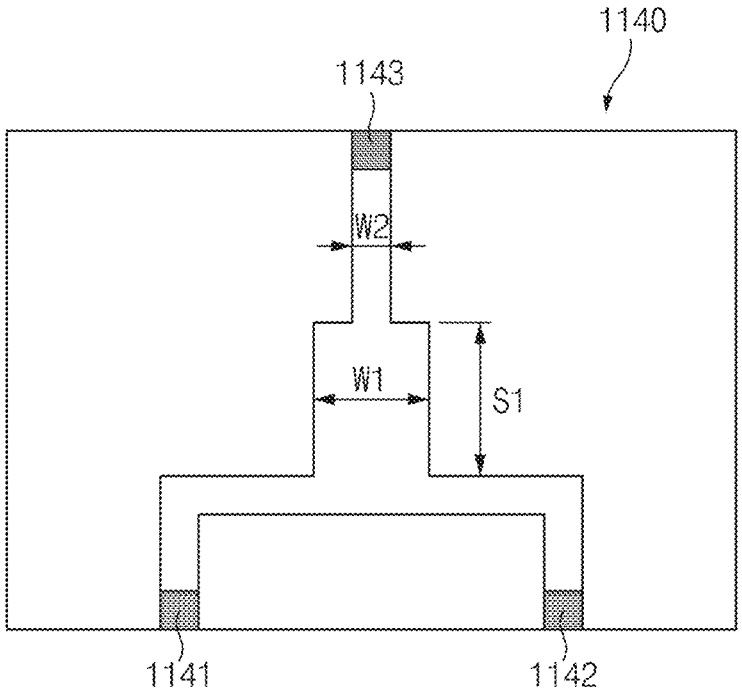
FIG. 15 is a diagram illustrating a structure of a coupling part according to an embodiment of the disclosure.

In an embodiment, the antenna structure 240 may have a structure in which the first conductive patch 241 and the second conductive patch 242 are symmetrical to the third conductive patch 243 and the fourth conductive patch 244. Four feeding points may be formed at the same positions of the first conductive patch 241 and the second conductive patch 242. Four feeding points that are symmetrical to the four feeding points of the first conductive patch 241 may be formed at the fourth conductive patch 244, and four feeding points that are symmetrical to the four feeding points of the second conductive patch 242 may be formed at the third conductive patch 243. The wireless communication circuit 250 may be connected with feeding parts of the first conductive patch 241 to the fourth conductive patch 244 through transmission lines at a plurality of ports for at least one of transmission or reception. For example, the plurality of ports and the feeding parts may be connected in a one-to-one correspondence structure. For another example, the plurality of ports and the feeding parts may be connected in a state where at least some transmission lines are combined through a combiner as illustrated in FIG. 15. To minimize the number of transmission lines connecting the wireless communication circuit 250 with the first conductive patch 241 to the fourth conductive patch 244, the antenna structure 240 may be implemented such that positions of the feeding points of the first conductive patch 241 and the second conductive patch 242 are symmetrical to positions of the feeding points of the third conductive patch 243 and the fourth conductive patch 244.

In an embodiment, a polarization may be formed to be diagonal (or oblique) with respect to an edge of the antenna structure 240. Each of the first conductive patch 241 to the fourth conductive patch 244 may form a first polarization and a second polarization that are orthogonal to each other. The first polarization and the second polarization may be formed in the shape of "X", not in the shape of "+", with respect to the edge of the antenna structure 240. The first polarization and the second polarization may be formed to be diagonal (or oblique) in a length direction of the antenna structure 240, not in the x-axis direction being a length direction of the antenna structure 240 or in the y-axis direction being a width direction of the antenna structure 240.

In an embodiment, a length of the ground of the antenna structure 240 may be longer in the x-axis direction than in the y-axis direction. An amplitude difference between a vertically polarized signal and a horizontally polarized signal may occur due to the influence of the ground of the antenna structure 240. As such, the first polarization and the second polarization may be formed to be diagonal (or oblique) in the length direction of the antenna structure 240 such that the amplitude of the vertically polarized signal is identical to the amplitude of the horizontally polarized signal.

In an embodiment, the 16 feeding points disposed at the first conductive patch 241 to the fourth conductive patch 244 may be fed. The 16 feeding points may be formed at the four conductive patches 241 to 244. As such, the multi feeding in which each of the conductive patches 241 to 244 has four feeding points may be implemented.

Figure 12:
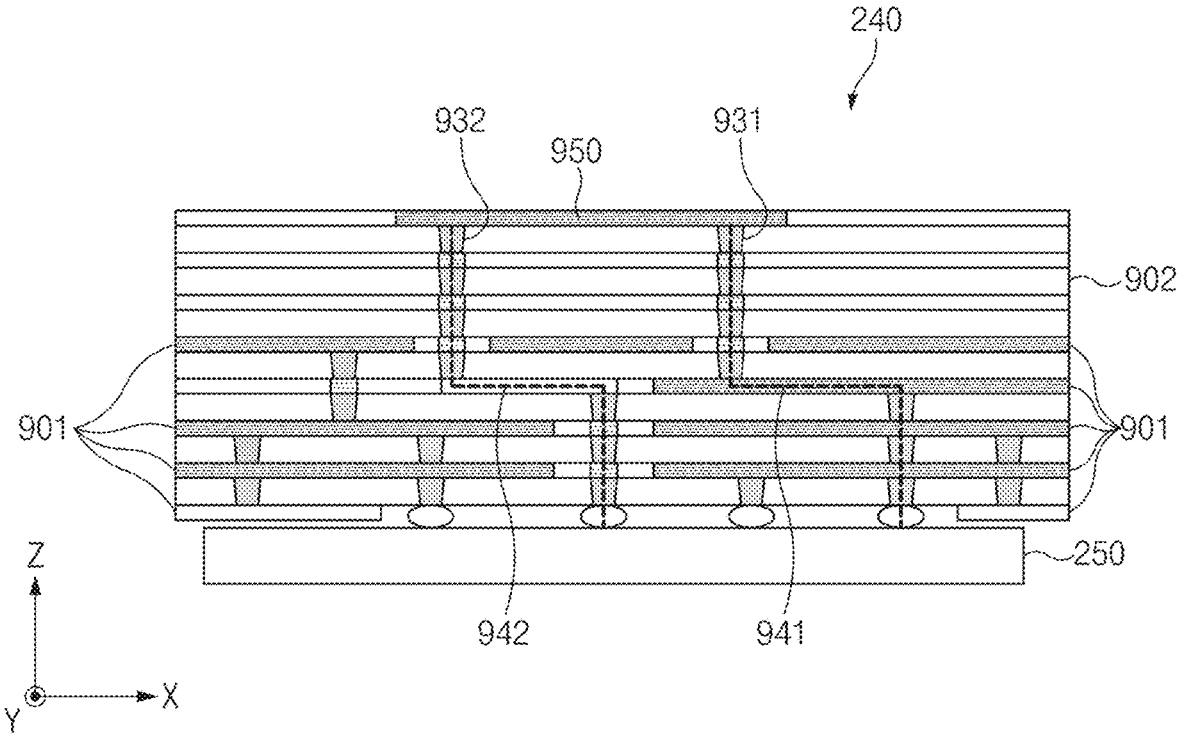
FIG. 12 is a diagram illustrating a feeding structure of an antenna structure according to an embodiment of the disclosure.

FIG. 12 is a diagram illustrating a feeding structure of the antenna structure 240 according to an embodiment of the disclosure. The antenna structure 240 may include a PCB and the wireless communication circuit 250.

In an embodiment, the PCB may include a plurality of conductive layers 901, a plurality of insulating layers 902, and a conductive patch 950. The plurality of conductive layers 901 and the plurality of insulating layers 902 may be disposed within the PCB. The conductive patch 950 may be disposed on one surface of the PCB or within the PCB. The conductive patch 950 may be referred to as one conductive patch of the plurality of conductive patches 241 to 244 described with reference to FIG. 8.

In an embodiment, the plurality of conductive layers 901 and the plurality of insulating layers 902 may be stacked in turn. For example, the plurality of conductive layers 901 and the plurality of insulating layers 902 may form a layer structure composed of a plurality of layers. The plurality of conductive layers 901 may include a conductive material such as metal. The plurality of insulating layers 902 may include a non-conductive material.

In an embodiment, the wireless communication circuit 250 may be disposed on another surface of the PCB. For example, the wireless communication circuit 250 may be disposed under the PCB with respect to the z-axis.

In an embodiment, the conductive patch 950 may be fed from the wireless communication circuit 250 to cause an electromagnetic resonance. The conductive patch 950 may radiate an electromagnetic signal in the +z axis direction.

According to an embodiment, the conductive patch 950 may be fed through a plurality of via holes 931 and 932 that are formed within the plurality of conductive layers 901 and the plurality of insulating layers 902. The plurality of via holes 931 and 932 may be formed at at least a part of the plurality of conductive layers 901 and the plurality of insulating layers 902. The plurality of via holes 931 and 932 may penetrate the layer structure composed of the plurality of conductive layers 901 and the plurality of insulating layers 902.

In an embodiment, the plurality of conductive layers 901 and the plurality of via holes 931 and 932 may form a plurality of feeding paths 941 and 942. The plurality of via holes 931 and 932 may be filled with a conductive material.

In an embodiment, the conductive patch 950 and the wireless communication circuit 250 may be electrically connected through the plurality of feeding paths 941 and 942. The conductive patch 950 may be fed through the plurality of feeding paths 941 and 942. When the conductive patch 950 is fed by the wireless communication circuit 250, the electronic device 101 may perform communication by using a millimeter wave (mm wave) signal.

According to an embodiment, the plurality of conductive layers 901 may form a portion of an antenna. For example, at least a part of the plurality of conductive layers 901 may operate as a ground with regard to the wireless communication circuit 250 and the conductive patch 950. For another example, at least a part of the plurality of conductive layers 901 may operate as a radiator for transmitting or receiving an RF signal of a specified frequency.

Figure 13A:
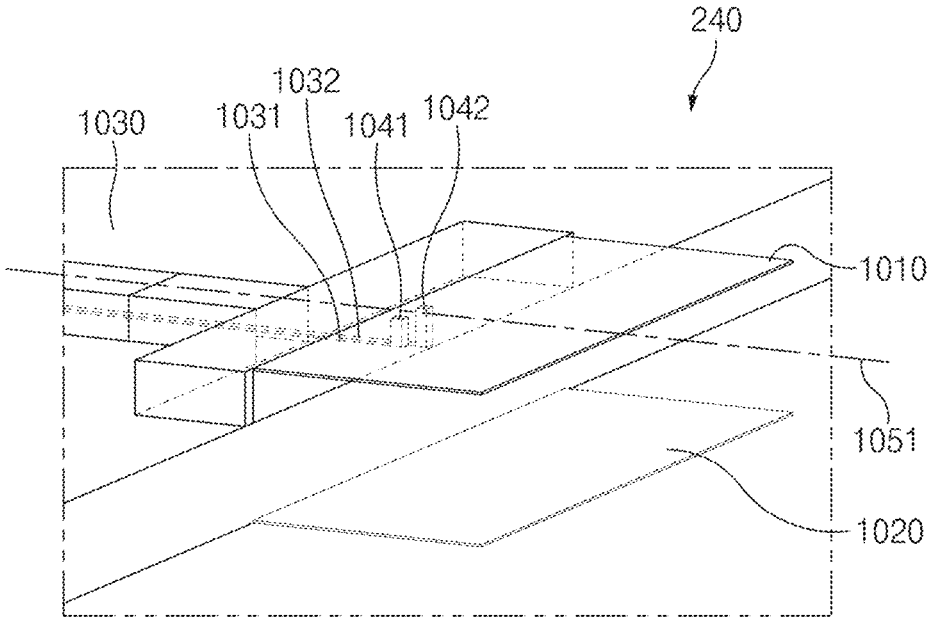
FIGS. 13A and 13B are diagrams illustrating a feeding structure of an antenna structure according to various embodiments of the disclosure.
Figure 13B:
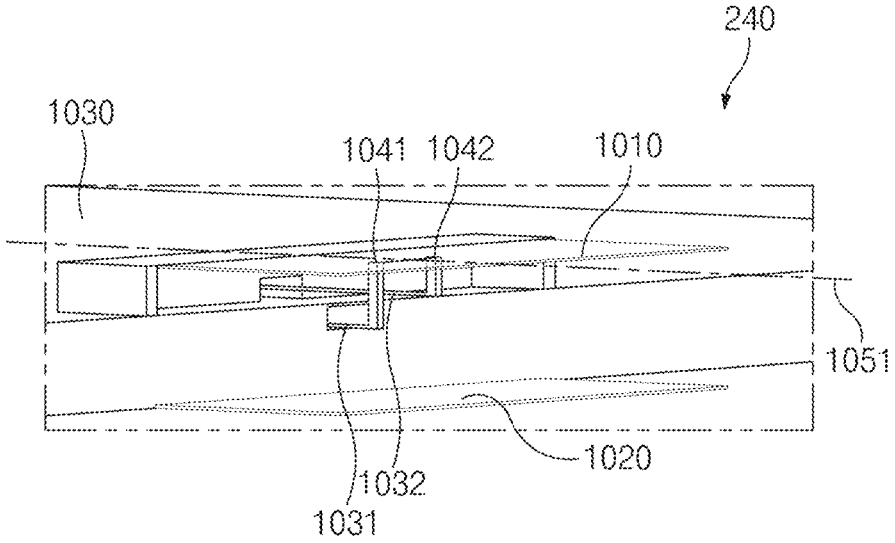

FIGS. 13A and 13B are diagrams illustrating a feeding structure of the antenna structure 240 according to various embodiments of the disclosure.

In an embodiment, the antenna structure 240 may include a first antenna element 1010 and a second antenna element 1020. The first antenna element 1010 and the second antenna element 1020 may form a vertical polarization. The first antenna element 1010 may be spaced from the second antenna element 1020 in parallel. For example, one surface of the first antenna element 1010 and one surface of the second antenna element 1020 may be disposed to face each other. The first antenna element 1010 and the second antenna element 1020 may function as a radiator of a patch antenna. At least one of the first antenna element 1010 or the second antenna element 1020 may be referred to as one of the conductive patches 241 to 244 described with reference to FIG. 8.

In an embodiment, the first antenna element 1010 and the second antenna element 1020 may be formed on at least one surface of a PCB 1030 or within the PCB 1030. Although omitted in FIGS. 13A and 13B to indicate the feeding structure, an insulator forming at least a portion of the PCB 1030 may be filled between the first antenna element 1010 and the second antenna element 1020. The PCB 1030 may be referred to as a low-loss printed circuit board appropriate for a high-frequency signal.

In an embodiment, the PCB 1030 may include a first feeding line 1031 and a second feeding line 1032. For example, when viewed from above the PCB 1030, at least a portion of a first feeding part 1041 or at least a portion of a second feeding part 1042 may overlap the first antenna element 1010.

In an embodiment, the first antenna element 1010 may be fed through a first feeding part 1041 and a second feeding part 1042. In the specification, the first feeding part 1041 may be referred to as the first position 610, and the second feeding part 1042 may be referred to as the second position 620. The second antenna element 1020 may be electrically connected with a ground area included in the PCB 1030.

In an embodiment, the first feeding line 1031 may electrically connect the first feeding part 1041 and the wireless communication circuit 250. The second feeding line 1032 may electrically connect the second feeding part 1042 and the wireless communication circuit 250. Positions of the first feeding part 1041 and the second feeding part 1042 may be disposed to be symmetrical with respect to a first imaginary axis 1051 parallel to a polarization direction. The wireless communication circuit 250 may feed the first feeding part 1041 through the first feeding line 1031 and may feed the second feeding part 1042 through the second feeding line 1032. The wireless communication circuit 250 may at least one of transmit or receive vertical polarization by using the first antenna element 1010 and the second antenna element 1020.

Figure 14A:
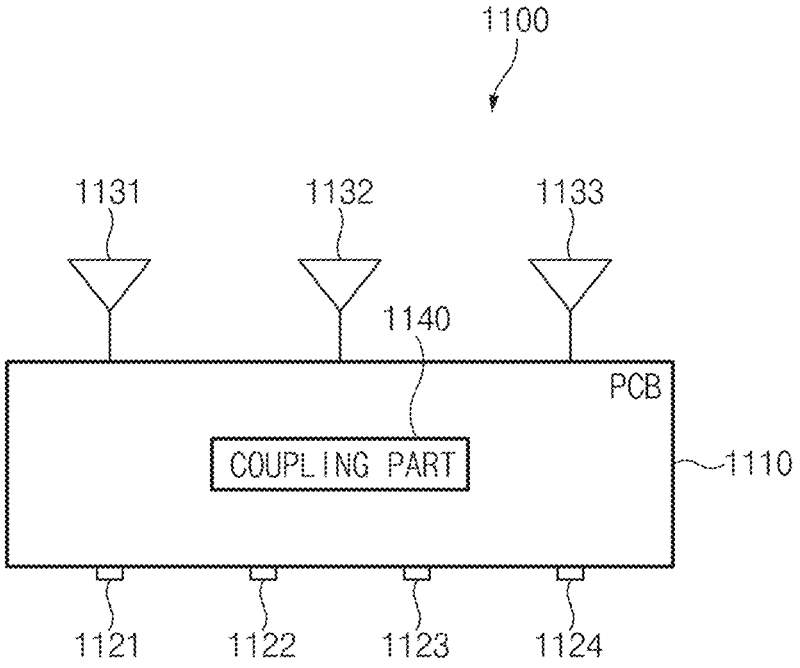
FIG. 14A is a diagram illustrating at least one of a printed circuit board (PCB), a plurality of ports, a plurality of antenna elements, or a coupling part of an antenna structure according to an embodiment of the disclosure.

FIG. 14A is a diagram illustrating at least one of a PCB 1110, a plurality of ports 1121 to 1124, a plurality of antenna elements 1131 to 1133, or a coupling part 1140 of an antenna structure 1100 according to an embodiment of the disclosure.

The plurality of ports 1121 to 1124 of the antenna structure 1100 of FIG. 14A may be components that perform substantially the same functions as the plurality of ports described with reference to FIGS. 6, 7, 8, 9, 10A, 10B, and 11. Also, the plurality of antenna elements 1131 to 1133 of the antenna structure 1100 of FIG. 14A may be components that perform substantially the same functions as the first antenna element 1010 and the second antenna element 1020 described with reference to FIGS. 13A and 13B. The wireless communication circuit 250 may feed the plurality of ports 1121 to 1124 such that the plurality of antenna elements 1131 to 1133 radiate an RF signal.

In an embodiment, the plurality of ports 1121 to 1124 may be disposed on at least a part of transmission lines included in the PCB 1110. For example, four transmission lines may be connected with the plurality of ports 1121 to 1124.

In an embodiment, the plurality of antenna elements 1131 to 1133 may be connected with the plurality of ports 1121 to 1124. At least a part of the plurality of ports 1121 to 1124 may be directly connected with the plurality of antenna elements 1131 to 1133, and at least a part of the plurality of ports 1121 to 1124 may be connected with the plurality of antenna elements 1131 to 1133 by using the coupling part 1140. For example, the first port 1121 may be directly connected with the first antenna element 1131, the fourth port 1124 may be directly connected with the third antenna element 1133, and the second and third ports 1122 and 1123 may be connected with the second antenna element 1132 by using the coupling part 1140. For example, the coupling part 1140 may have the structure illustrated in FIG. 15 and may connect the second and third ports 1122 and 1123 with the second antenna element 1132.

In an embodiment, the plurality of antenna elements 1131 to 1133 may be connected with the wireless communication circuit 250 by using the plurality of ports 1121 to 1124. The wireless communication circuit 250 may feed the plurality of antenna elements 1131 to 1133. The plurality of antenna elements 1131 to 1133 may radiate signals.

In an embodiment, the number of the plurality of ports 1121 to 1124 included in the antenna structure 1100 may be more than the number of the plurality of antenna elements 1131 to 1133. For example, as illustrated in FIG. 14A, the number of the plurality of ports 1121 to 1124 included in the antenna structure 1100 may be "4", and the number of the plurality of antenna elements 1131 to 1133 included in the antenna structure 1100 may be "3".

In an embodiment, the PCB 1110 may connect the plurality of ports 1121 to 1124 and the plurality of antenna elements 1131 to 1133. For example, the first port 1121 may be connected with the first antenna element 1131. The second port 1122 and the third port 1123 may be connected with the second antenna element 1132. The fourth port 1124 may be connected with the third antenna element 1133.

In an embodiment, the antenna structure 1100 may further include the coupling part 1140 that connects two or more ports with one antenna element. For example, the coupling part 1140 of FIG. 14A may connect the second port 1122 and the third port 1123 with the second antenna element 1132. The coupling part 1140 may receive signals from the second port 1122 and the third port 1123. The coupling part 1140 may combine the signals input to the second port 1122 and the third port 1123. The coupling part 1140 may output the combined signal to the second antenna element 1132.

In an embodiment, the coupling part 1140 may be implemented with a combiner. For example, the coupling part 1140 may be implemented with a T-type junction combiner that combines signals of two or more different input ports. In the T-type junction combiner, in the case where signals input to two or more different input ports are in phase, a signal, of which a magnitude is identical to a sum of magnitudes of the signals, may be output to an output port. For another example, the coupling part 1140 may be implemented with a transmission line in which an input impedance being a sum of impedances of input ports is matched with an output impedance of an output port.

In an embodiment, a signal supplied to the second port 1122 connected with the coupling part 1140 and a signal supplied to the third port 1123 may be in phase. As such, in the case where the signal supplied to the second port 1122 and the signal supplied to the third port 1123 are combined, a signal, of which a phase is identical to a phase of a signal supplied to one port, may be supplied to the second antenna element 1132.

In an embodiment, a magnitude of a signal supplied to the second port 1122 connected to the coupling part 1140 and a magnitude of a signal supplied to the third port 1123 connected to the coupling part 1140 may be smaller than a magnitude of a signal supplied to each of the first port 1121 and the fourth port 1124 being the remaining ports other than the ports 1122 and 1123 connected to the coupling part 1140. In the case of decreasing a magnitude of a signal supplied to each of the plurality of ports 1121 to 1124, power consumption may be reduced. For example, in the case of halving a magnitude of a signal to be supplied to the second port 1122 and a magnitude of a signal to be supplied to the third port 1123, a magnitude of a signal output from the second antenna element 1132 may be substantially identical to a magnitude of a signal output from the first antenna element 1131 or the third antenna element 1133. As such, a power that is consumed at each of the second port 1122 and the third port 1123 may be halved.

In an embodiment, a magnitude of a signal supplied to the second port 1122 connected to the coupling part 1140 and a magnitude of a signal supplied to the third port 1123 connected to the coupling part 1140 may be substantially identical to a magnitude of a signal supplied to each of the first port 1121 and the fourth port 1124 being the remaining ports other than the ports 1122 and 1123 connected to the coupling part 1140. In the case of maintaining magnitudes of signals to be supplied to the ports 1122 and 1123 connected to the coupling part 1140, a magnitude of a signal output from the second antenna element 1132 connected with the coupling part 1140 may be greater than a magnitude of a signal output from the first antenna element 1131 or the third antenna element 1133. For example, in the case where a magnitude of a signal to be supplied to each of the ports 1122 and 1123 connected to the coupling part 1140 is identical to a magnitude of a signal to be supplied to each of the first port 1121 and the fourth port 1124, a magnitude of a signal output from the second antenna element 1132 may be two times a magnitude of a signal output from the first antenna element 1131 or the third antenna element 1133. In the case where an output power of the second antenna element 1132 disposed on the center is doubled, the size of a side lobe of the antenna structure 1100 may decrease due to a tapering effect. As such, the radiation performance of the antenna structure 1100 supporting 5G micro wave communication may be improved.

Figure 14B:
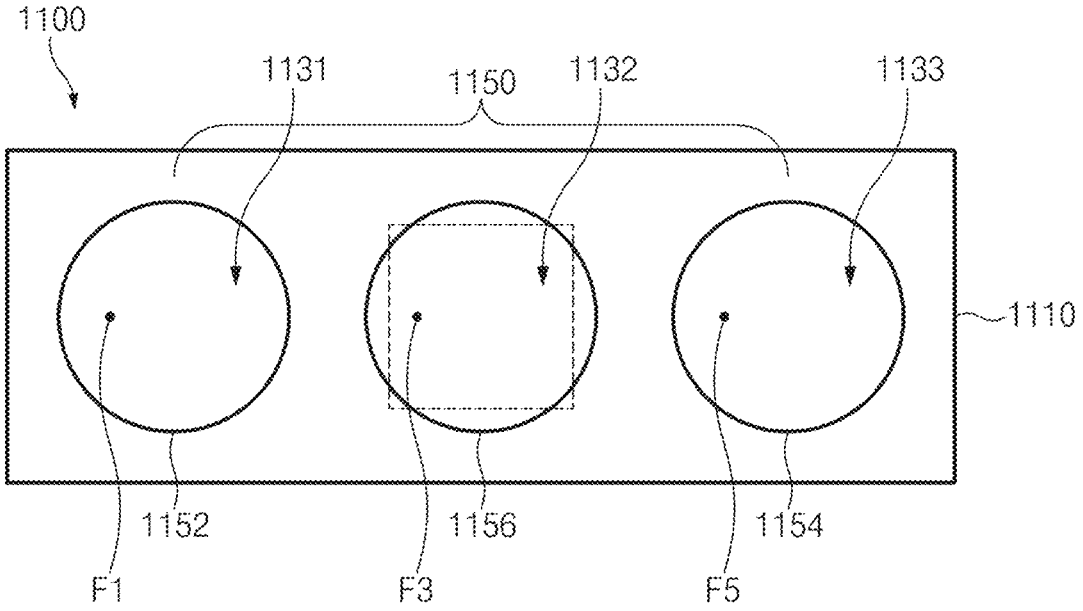
FIG. 14B is a diagram illustrating a structure of an antenna structure of FIG. 14A according to an embodiment of the disclosure.

FIG. 14B is a diagram illustrating a structure of the antenna structure 1100 of FIG. 14A according to an embodiment of the disclosure. The antenna structure 1100 of FIG. 14B may include the PCB 1110, antenna patches 1150 corresponding to the first to third antenna elements 1131, 1132, and 1133 of FIG. 14A, and a plurality of feeding parts F1, F3, and F5.

In an embodiment, the antenna patches 1150 may be fed through the plurality of feeding parts F1, F3, and F5, respectively. For example, a first antenna patch 1152 may be fed through the first feeding part F1, a second antenna patch 1154 may be fed through the fifth feeding part F5, and a third antenna patch 1156 may be fed through the third feeding part F3. A position of the first feeding part F1, the third feeding part F3, or the fifth feeding part F5 may be determined depending on a polarization direction.

In an embodiment, the third antenna patch 1156 may be supplied with a signal, which is obtained by combining signals transmitted through a plurality of transmission lines at the coupling part 1140, through the third feeding part F3. As such, the third antenna patch 1156 may radiate a signal, of which a magnitude is greater than the first antenna patch 1152 or the second antenna patch 1154.

FIG. 15 is a diagram illustrating a structure of the coupling part 1140 according to an embodiment of the disclosure.

In an embodiment, the coupling part 1140 may include input port connecting parts 1141 and 1142 and an output port connecting part 1143. The input port connecting parts 1141 and 1142 may be respectively connected with ports connected with the coupling part 1140 from among the one or more ports 1121 to 1124. The output port connecting part 1143 may be connected with an antenna element connected with the coupling part 1140 from among the at least one or more antenna elements 1131 to 1133.

In an embodiment, the coupling part 1140 may include a structure of coupling the input port connecting parts 1141 and 1142. For example, the coupling part 1140 may have a first structure S1 in which the input port connecting parts 1141 and 1142 are connected at a central portion of the coupling part 1140 through a transmission line formed of a conductive material and signals input to the input port connecting parts 1141 and 1142 are combined at the central portion.

In an embodiment, the first structure S1 may connect the input port connecting parts 1141 and 1142 with the output port connecting part 1143. The first structure S1 may be adjusted such that a magnitude of an input impedance is identical to a magnitude of an output impedance. The first structure S1 may have a first width W1 so as to control a magnitude of the impedance. For example, in the case of controlling a magnitude of the impedance of the first structure S1 so as to have 25Ω smaller than 50Ω being an impedance of a typical transmission line, the first width W1 may be greater than a second width W2 being a width of a transmission line.

Figure 16:
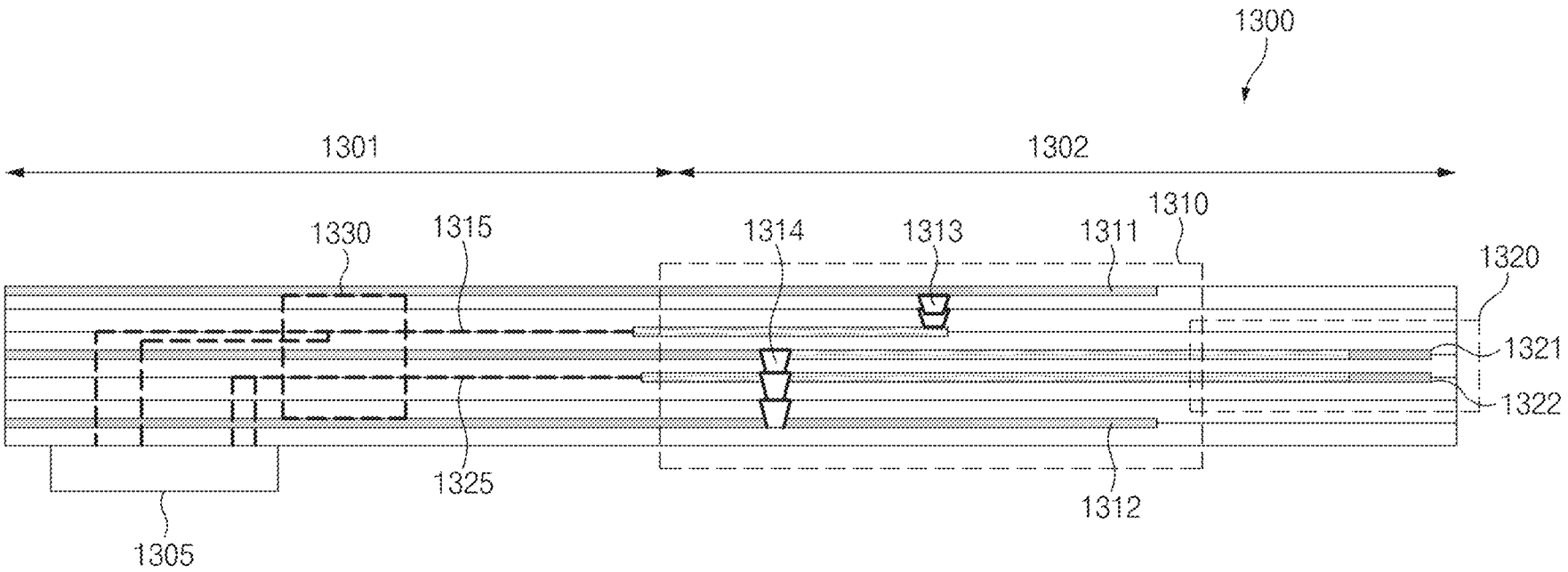
FIG. 16 is a diagram illustrating an antenna structure according to another embodiment of the disclosure.

FIG. 16 is a diagram illustrating an antenna structure 1300 according to another embodiment of the disclosure.

In an embodiment, the antenna structure 1300 may include a first area 1301 where a wireless communication circuit 1305 supplies a power and a second area 1302 where an RF signal is radiated. The wireless communication circuit 1305 of FIG. 16 is substantially identical to the wireless communication circuit 250 described with reference to FIG. 5, and thus, additional description will be omitted to avoid redundancy.

In an embodiment, the first area 1301 may form a feeding network. The wireless communication circuit 1305, and a first feeding line 1315 and a second feeding line 1325, which connect the wireless communication circuit 1305 and the second area 1302, may be disposed in the first area 1301. Functions of the first feeding line 1315 and the second feeding line 1325 of FIG. 16 are substantially identical to the functions of the first feeding line 1031 and the second feeding line 1032 of FIGS. 13A and 13B, and thus, additional description will be omitted to avoid redundancy.

In an embodiment, a first antenna 1310 may radiate a vertically polarized signal. The first antenna 1310 may form a vertically polarized antenna array. The first antenna 1310 may be fed through a first feeding part 1313.

In an embodiment, a second antenna 1320 may radiate a horizontally polarized signal. The second antenna 1320 may form a horizontally polarized antenna array. The second antenna 1320 may be fed through a second feeding part 1314.

In an embodiment, a coupling part 1330 for coupling at least a part of a plurality of sub feeding lines may be disposed in the first area 1301. The coupling part 1330 may include the coupling part 1140 of FIG. 15. For example, the coupling part 1330 may perform substantially the same at least one of structure or function as the coupling part 1140 of FIG. 15.

In an embodiment, the first feeding part 1313 may be connected with the first feeding line 1315 being a single transmission line connected with the wireless communication circuit 1305. The second feeding part 1314 may be connected with the second feeding line 1325 being a single transmission line connected with the wireless communication circuit 1305. The wireless communication circuit 1305 may feed the first feeding part 1313 through the first feeding line 1315. The wireless communication circuit 1305 may feed the second feeding part 1314 through the second feeding line 1325.

In an embodiment, the first antenna 1310 and the second antenna 1320 may be disposed in the second area 1302. The first antenna 1310 may include a first antenna element 1311 and a second antenna element 1312. The second antenna 1320 may include a third antenna element 1321 and a fourth antenna element 1322. The first antenna element 1311 to the fourth antenna element 1322 of FIG. 16 may be different from the first antenna element 1010 and the second antenna element 1020 of FIGS. 13A and 13B or the plurality of antenna elements 1131 to 1133 of FIGS. 14A and 14B. The first antenna element 1311 and the second antenna element 1312 may be referred to as a "conductive plate". The third antenna element 1321 and the fourth antenna element 1322 may be referred to as a "conductive element" (e.g., a conductive pattern).

In an embodiment, the first antenna element 1311 may be spaced from the second antenna element 1312 and may be disposed parallel to the second antenna element 1312. The first antenna 1310 may be a patch antenna. The second antenna 1320 may be a dipole antenna.

For example, the second area 1302 may include at least one ground layer. At least a portion of the first antenna 1310 and the second antenna 1320 may be connected with the ground layer.

In an embodiment, the first antenna 1310 and the second antenna 1320 may be electrically connected with the wireless communication circuit 1305. The wireless communication circuit 1305 may transmit/receive an RF signal of a vertical polarization characteristic by using the first antenna 1310. The wireless communication circuit 1305 may transmit/receive an RF signal of a horizontal polarization characteristic by using the second antenna 1320.

Figure 17:
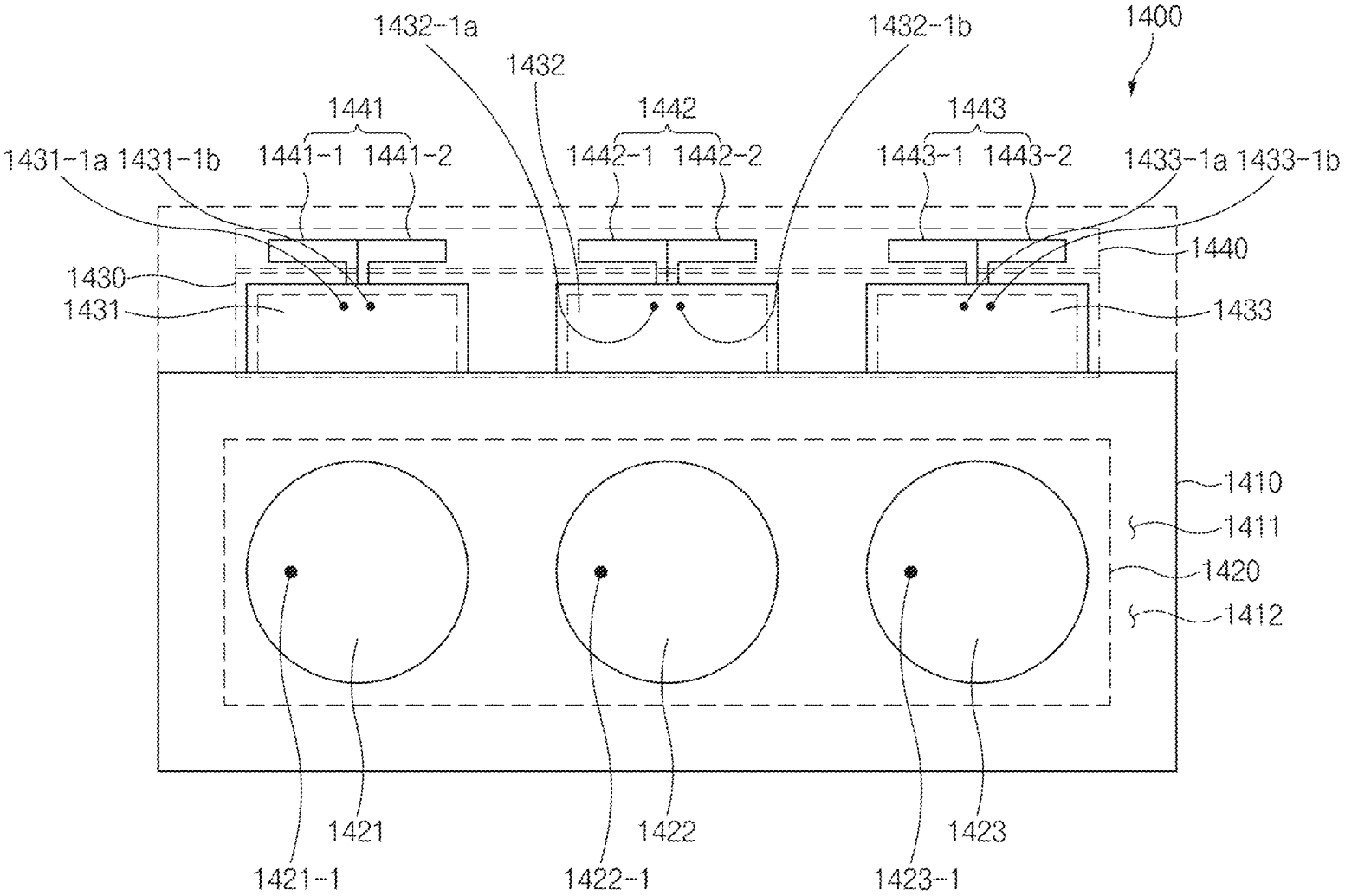
FIG. 17 is a diagram illustrating an antenna structure according to another embodiment of the disclosure.

FIG. 17 is a diagram illustrating an antenna structure 1400 according to an embodiment of the disclosure. The antenna structure 1400 may include at least one of a PCB 1410, a first antenna array 1420, a second antenna array 1430, or a third antenna array 1440.

In an embodiment, the PCB 1410 may include a first surface 1411, and a second surface 1412 facing away from the first surface 1411. The first antenna array 1420 may be disposed on the first surface 1411 of the PCB 1410 or may be interposed between the first surface 1411 and the second surface 1412. The second antenna array 1430 and the third antenna array 1440 may be disposed on one side of the PCB 1410.

In an embodiment, the first antenna array 1420 may include first to third patch antennas 1421, 1422, and 1423. The first to third patch antennas 1421, 1422, and 1423 may be substantially identical to the conductive patch 400, 500, or 600 of FIG. 7, 8, or 9. The first to third patch antennas 1421, 1422, and 1423 may be fed through feeding points 1421-1, 1422-1, and 1423-1.

In an embodiment, the second antenna array 1430 may include fourth to sixth patch antennas 1431, 1432, and 1433. The fourth to sixth patch antennas 1431, 1432, and 1433 may be substantially identical to the first and second antenna elements 1311 and 1312 of FIG. 16. The fourth to sixth patch antennas 1431, 1432, and 1433 may be formed in the shape of a conductive plate. The fourth to sixth patch antennas 1431, 1432, and 1433 may be fed through a plurality of feeding points 1431-1*a*, 1431-1*b*, 1432-1*a*, 1432-1*b*, 1433-1*a*, and 1433-1*b*. For example, the fourth to sixth patch antennas 1431, 1432, and 1433 may be multiple-fed by using the same structure as the first feeding part 1041 and the second feeding part 1042 of FIGS. 13A and 13B.

In an embodiment, the third antenna array 1440 may include first to third dipole antennas 1441, 1442, and 1443. The first to third dipole antennas 1441, 1442, and 1443 may be substantially identical to the second antenna elements 1321 and 1322 of FIG. 16. The first to third dipole antennas 1441, 1442, and 1443 may be formed as dipole radiators of a conductive pattern shape. The antenna structure 1400 may implement the patch antenna structure and the dipole antenna structure illustrated in FIG. 16 at the one PCB 1410.

In an embodiment, the first dipole antenna 1441 may have two antenna elements 1441-1 and 1441-2. For another example, the second dipole antenna 1442 may have two antenna elements 1442-1 and 1442-2. For another example, the third dipole antenna 1443 may have two antenna elements 1443-1 and 1443-2. Two transmission lines may be connected with each of the antenna elements 1441-1, 1441-2, 1442-1, 1442-2, 1443-1, and 1443-2.

In an embodiment, the output port connecting part 1143 of the coupling part 1140 illustrated in FIG. 15 may be connected with each of the antenna elements 1441-1, 1441-2, 1442-1, 1442-2, 1443-1, and 1443-2. The coupling part 1140 may connect two transmission lines respectively connected to two input port connecting parts 1141 and 1142 such that signals applied to the two input port connecting parts 1141 and 1142 are combined. As such, in the case of using the coupling part 1140, a total of four transmission lines may be connected with each of the first to third dipole antennas 1441, 1442, and 1443. As such, each of the first to third dipole antennas 1441, 1442, and 1443 may be multiple-fed by using four transmission lines.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to embodiments of the disclosure, even though the number of antenna elements included in an antenna structure decreases, the performance of the antenna structure may be maintained by maintaining the total number of feeding ports connected to the antenna structure.

Also, according to embodiments of the disclosure, it may be possible to improve the performance of the antenna structure supporting high-frequency communication.

Besides, a variety of effects directly or indirectly understood through this disclosure may be provided.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a including comprising:

a first plate, a second plate facing away from the first plate, and a side member surrounding a space between the first plate and the second plate, the side member being connected to the second plate or integrally formed with the second plate;

a display viewable through at least a portion of the first plate;

an antenna structure disposed within the housing, the antenna structure comprising:

a printed circuit board including a first surface and a second surface facing away from the first surface, and at least one conductive patch interposed between the first surface and the second surface, or disposed on the first surface, the at least one conductive patch comprising first to fourth areas placed in a clockwise direction with respect to a first imaginary axis extending a first direction on the at least one conductive patch and a second imaginary axis intersecting the first imaginary axis at a central point, the second imaginary axis being perpendicular to the first imaginary axis on the at least one conductive patch; and at least one wireless communication circuit configured to at least one of transmit or receive a first signal having a frequency between 3 GHz and 100 GHz, the at least one wireless communication circuit comprising:

a first port electrically connected to a first position of the first area, and a second port electrically connected to a second position placed on an opposite side to the first position with respect to the first imaginary axis, the first position and the second position being spaced from the central point at a first distance, the first distance being determined based on an impedance of the at least one conductive patch.

2. The electronic device of claim 1, wherein a magnitude and a phase of the first signal, which is fed to the at least one conductive patch from each of the first port and the second port, are identical.

3. The electronic device of claim 1, wherein, based on the at least one conductive patch being connected to the at least one wireless communication circuit with a single port, the first distance is shorter than a second distance by which the single port is spaced from the central point.

4. The electronic device of claim 1, wherein the at least one wireless communication circuit further comprises a third port electrically connected to a third position on the first imaginary axis.

5. The electronic device of claim 4, wherein the third position of the third port is spaced from the central point at the first distance determined based on the impedance of the at least one conductive patch.

6. The electronic device of claim 1, wherein a first angle that the first position and the second position form based at least on the first imaginary axis is an acute angle.

7. The electronic device of claim 1, wherein the at least one wireless communication circuit further comprises a third port and a fourth port respectively connected to a third position and a fourth position, the third position and the fourth position being respectively placed on opposite sides to the first position and the second position with respect to the second imaginary axis, and wherein a second signal having a phase difference of 180 degrees with the first signal is transmitted to each of the third port and the fourth port.

8. The electronic device of claim 1, wherein the antenna structure further comprises a coupling part connecting the first port and to the second port on the at least one conductive patch.

9. The electronic device of claim 8, wherein the coupling part comprises at least one of a T-type junction combiner configured to combine signals of the first port and the second port, or a transmission line in which an input impedance and an output impedance are matched.

10. An electronic device comprising:

a housing comprising:

a first plate, a second plate facing away from the first plate, and a side member surrounding a space between the first plate and the second plate, the side member being connected to the second plate or integrally formed with the second plate;

a display viewable through at least a portion of the first plate;

at least one wireless communication circuit comprising a first port and a second port, the at least one wireless communication circuit being configured to at least one of transmit or receive a first signal having a frequency between 3 GHz and 100 GHz; and an antenna structure disposed within the housing, the antenna structure comprising:

a printed circuit board comprising a first surface and a second surface facing away from the first surface, at least one conductive pattern being interposed between the first surface and the second surface or disposed on the first surface, the first port and the second port being electrically connected to a first position and a second position, respectively, of the at least one conductive pattern, the first position being located on an opposite side to the second position with respect to an imaginary axis of the at least one conductive pattern, and a combiner electrically connected to the first port, the second port, and the at least one conductive pattern, the first position and the second position being spaced from a central point of the at least one conductive pattern at a distance determined based on an impedance of the at least one conductive pattern.

11. The electronic device of claim 10, wherein a magnitude and a phase of the first signal that the at least one wireless communication circuit feeds to the first port are identical to a magnitude and a phase of the first signal that the at least one wireless communication circuit feeds to the second port.

12. The electronic device of claim 10, wherein the at least one wireless communication circuit feeds the first port and the second port to generate a first polarization in a first direction on the at least one conductive pattern.

13. The electronic device of claim 10, wherein the combiner includes a first input part and a second input part, wherein the first port is electrically connected to the first input part, and wherein the second port is electrically connected to the second input part.

14. The electronic device of claim 10, wherein the printed circuit board further comprises a layer structure in which a plurality of conductive layers and a plurality of insulating layers are stacked in turn, and wherein a plurality of via holes penetrating the layer structure are formed.

15. The electronic device of claim 10, wherein the at least one conductive pattern is included in at least one of a patch antenna, a dipole antenna, a monopole antenna, or a loop antenna.

16. The electronic device of claim 10, wherein the at least one wireless communication circuit further comprises a third port and a fourth port electrically connected to the at least one conductive pattern, wherein a phase of a second signal fed to each of the third port and the fourth port is identical to a phase of the first signal fed to each of the first port and the second port, and wherein a magnitude of the first signal fed to each of the first port and the second port is smaller than or equal to a magnitude of the second signal fed to each of the third port and the fourth port.

17. An electronic device comprising:

a housing comprising:

a first plate, a second plate facing away from the first plate, and a side member surrounding a space between the first plate and the second plate, the side member being connected to the second plate or integrally formed with the second plate;

an antenna structure disposed within the housing;

a wireless communication circuit connected to the antenna structure and configured to at least one of transmit or receive a first signal of a specified frequency; and one or more processors operatively connected to the wireless communication circuit, wherein the antenna structure comprises an antenna element, wherein the wireless communication circuit comprises a first feeding part and a second feeding part connected to a first position and a second position, respectively, of the antenna element, wherein the wireless communication circuit feeds the first feeding part and the second feeding part, wherein the first feeding part is connected to the antenna element through a first feeding line at the first position, wherein the second feeding part is connected to the antenna element through a second feeding line at the second position, and wherein the first position and the second position are symmetrical with respect to an imaginary axis extended in a direction on the antenna element, the first position and the second position being spaced from a central point of the antenna element at a distance determined based on an impedance of the antenna element.

18. The electronic device of claim 17, wherein a magnitude and a phase of the signal that the wireless communication circuit feeds to the first feeding part are identical to a magnitude and a phase of the signal that the wireless communication circuit feeds to the second feeding part.

19. The electronic device of claim 17, wherein the antenna structure further comprises a coupling part connecting the first feeding line to the second feeding line in an area adjacent to the antenna element.

20. The electronic device of claim 19, wherein the coupling part forms the first feeding line and the second feeding line by using a plurality of sub feeding lines extended from the wireless communication circuit.

21. The electronic device of claim 17, wherein the wireless communication circuit feeds the first feeding part to generate a first polarization in the direction in which the imaginary axis extends, and wherein the wireless communication circuit feeds the second feeding part to generate a second polarization perpendicular to the first polarization.

* * * * *